US007007703B2

(12) United States Patent
Brooks, III.

(10) Patent No.: US 7,007,703 B2
(45) **Date of Patent: *Mar. 7, 2006**

(54) UMBRELLA WITH AN INTEGRAL ANCHORING STRUCTURE

(75) Inventor: Edward J. Brooks, III., Minneapolis, MN (US)

(73) Assignee: Wright Ventures, LLC, Minneapolis, MN (US)

( * ) Notice: Subject to any disclaimer, the term of this patent is extended or adjusted under 35 U.S.C. 154(b) by 110 days.

This patent is subject to a terminal disclaimer.

(21) Appl. No.: 10/810,378

(22) Filed: Mar. 26, 2004

(65) Prior Publication Data

US 2004/0177875 A1 Sep. 16, 2004

Related U.S. Application Data

(63) Continuation of application No. 09/862,649, filed on May 22, 2001, now Pat. No. 6,715,503.

(51) Int. Cl.
*E04H 15/28* (2006.01)

(52) U.S. Cl. ..... 135/16; 52/157

(58) Field of Classification Search ..... 248/545, 248/530; 52/157, 165; 135/15.1, 16, 98
See application file for complete search history.

(56) References Cited

U.S. PATENT DOCUMENTS

| | | | | |
|---|---|---|---|---|
| 495,471 A | | 4/1893 | Brown | |
| 906,438 A | | 12/1908 | Lemerand | |
| 2,211,283 A | | 8/1940 | Mercer | 135/15.1 |
| 2,347,443 A | * | 4/1944 | Vesely | 248/156 |
| 2,441,109 A | | 5/1948 | Carlson | 248/156 |
| 2,628,797 A | | 2/1953 | Campomar | 248/43 |
| 2,643,843 A | | 6/1953 | Brown | 248/156 |
| 3,318,560 A | | 5/1967 | Garrette | 248/44 |
| 3,572,045 A | | 3/1971 | Owen | 61/48 |
| 3,710,523 A | | 1/1973 | Taylor | 52/157 |
| 4,105,039 A | | 8/1978 | Schultes et al. | 135/25 |
| 4,753,411 A | | 6/1988 | Lechner et al. | 248/533 |
| 4,832,304 A | | 5/1989 | Morgulis | 248/533 |
| 4,920,897 A | | 5/1990 | Reed et al. | 108/150 |
| 5,046,699 A | | 9/1991 | Perreault et al. | 248/533 |
| 5,098,057 A | | 3/1992 | Gran et al. | 248/530 |
| 5,122,014 A | | 6/1992 | Genfan | 405/244 |
| 5,152,495 A | | 10/1992 | Jacinto et al. | 248/545 |

(Continued)

FOREIGN PATENT DOCUMENTS

AU 18976 2/1972

OTHER PUBLICATIONS

Crate&Barrel, Sand Anchor, Item #73046, Summer 2005 Catalogue, p. 9.

*Primary Examiner*—Janet M. Wilkens
(74) *Attorney, Agent, or Firm*—Brooks & Cameron, PLLC

(57) ABSTRACT

An umbrella with an integral anchoring structure is provided. The umbrella includes a post having a lower end for insertion into the ground, and an upper end for supporting an umbrella top. The umbrella includes an integral spiral shaped anchoring structure formed on the lower end of the post. The anchoring structure is formed with a width, W, greater than a diameter of the post and a length, L, which is adapted to stabilize a weight of the umbrella and secure the umbrella and the post in a variety of earthen conditions such as sand, lawn, and soil even in a prevailing breeze or stormier conditions. The umbrella further includes one or more retractable levers integrally attached along the post.

24 Claims, 14 Drawing Sheets

U.S. PATENT DOCUMENTS 5,156,369 A 10/1992 Tizzoni ..... 248/545
5,230,187 A 7/1993 Reinmann ..... 52/102
D341,831 S * 11/1993 Mozdzanowski ..... D14/168
5,271,196 A 12/1993 Fanti ..... 52/166
5,293,889 A 3/1994 Hall et al. ..... 135/16
5,358,209 A 10/1994 Ward ..... 248/545
5,454,435 A 10/1995 Reinhardt ..... 175/19
5,470,038 A * 11/1995 Clark ..... 248/156
5,482,246 A 1/1996 Derkowski ..... 248/530
D394,544 S * 5/1998 Tropiano ..... D3/10
5,749,386 A 5/1998 Samuel, Jr. ..... 135/16
5,906,077 A 5/1999 Andiarena ..... 52/157
5,921,035 A * 7/1999 Kempf ..... 52/157
6,199,569 B1 3/2001 Gibson ..... 135/16
6,758,456 B1 * 7/2004 Krieger ..... 248/530

* cited by examiner

UMBRELLA WITH AN INTEGRAL ANCHORING STRUCTURE

CROSS REFERENCE TO RELATED APPLICATIONS

This application is a Continuation of U.S. application Ser. No. 09/862,649 filed May 22, 2001, now U.S. Pat. No. 6,715,503 the specification of which is incorporated herein by reference.

FIELD OF THE INVENTION

The present invention relates to the field of outdoor umbrellas, and in particular to umbrellas with an integral anchoring structure.

BACKGROUND OF THE INVENTION

When people enjoy the outdoors, such as having a picnic in the countryside or going to the seashore, they often take with them an outdoor umbrella to provide a retreat and shade from the rays of the sun. Outdoor umbrellas generally consist of a retractable umbrella top attached to a post. The post is inserted into the ground by gripping the post and relying on arm strength to forcefully insert the post into the earth. Typical ground conditions for such an outdoor activity may include sand at the beach, lawn in a backyard, or other soil conditions at other picnic locations. These ground conditions are sometimes very compact requiring a great deal of arm strength and effort to obtain insertion of the post into the ground. In very compact ground conditions only a shallow insertion can be achieved. Alternatively, the user may carry with them a shovel or other digging device to create a hole in the ground and then fill the hole back in once the umbrella is inserted. A shallow insertion of the post into the ground creates the risk that the umbrella may tip over under its own weight or that in breezy conditions, or sudden wind gusts the umbrella may be ripped out of the ground and strike person, let alone the inconvenience of having to chase the umbrella down. The shovel solution only adds to the amount and weight of baggage which a person must transport with them on their excursion. And, even the shovel solution may not provide enough compactness around the post of the umbrella to firmly secure it in the earth enough to withstand breezy conditions or sudden wind gusts.

There have been several attempts at developing outdoor umbrellas which are easier for the user to insert in the earth, that is which don't rely so greatly on arm strength and effort to push the post into the ground. There have also been several attempts at anchoring umbrellas into the ground in a secure manner. Again, the purpose for anchoring umbrellas, such as beach umbrellas and lawn umbrellas, securely in the ground is to prevent the unwanted dislodgement of these umbrellas. One example of such unwanted dislodgement can occur in windy or stormy conditions. Under these conditions, air currents can catch hold of the umbrella tearing the same from the ground. Umbrellas without anchoring devices can generally be easy ripped from the ground under these conditions. This results in a great deal of inconvenience to anyone relying on the umbrella for shade, and may present a safety risk in crowded places where a blowing umbrella could injure people in its path. Another example of the unwanted dislodgement of umbrellas includes the dislodgement of the umbrella under its own weight. For instance, beach goers typically insert beach umbrellas into the sand by first applying weight and pressure to the umbrellas post in an effort to shove the post into the sand. In the case of loose sand, it may not be difficult to insert the post to a reasonable depth within the sand. However, in such loose sand, the weight of the umbrella top, itself, may cause the umbrella to tip over freeing the umbrella from its insertion in the sand. Alternatively, in the case of compact sand, it may be significantly more difficult to insert the post to a reasonable depth within the sand. In this case as well, the weight of the umbrella top itself can cause the umbrella to tip over easily freeing the umbrella from its shallow insertion in the sand. Both cases, present added inconvenience to the user trying to position the umbrella to obtain shade. Additionally, even if the umbrella does not tip over under its own weight, such a shallow insertion into the sand leaves the umbrella much more vulnerable to being ripped from the ground by wind and breezes as mentioned above.

One attempt to resolve the above described problems is provided in U.S. Pat. No. 5,046,699 to Perreault, et al. The Perreault patent discloses an anchoring device for an umbrella post. The anchoring device includes a screw member attached to a lower end of the umbrella post, which screw member can be rotationally driven into the ground for the purpose of securing the umbrella in place. Unfortunately, the device described by Perreault involves one or more separate attachments to an umbrella. Like carrying a separate shovel, this solution only adds to the amount and weight of baggage which a person must transport with them on their excursion. Typically, a beachgoer is already heavily laden with items such as beach chairs, umbrella, cooler, towels, and other beach toys when walking to the beach. Thus, any additional items to keep up with present an added hassle. Each additional item makes the outdoors travelers baggage more weighty and cumbersome. Attaching such separate parts to the umbrella further presents an added time delay to the beachgoer beginning their relaxation and enjoyment of the shore or other outdoor activity. In at least one embodiment of the Perreault patent, the device may even require additional tools for the fastening of a bolt across the umbrella post and the external tubular sleeve. Further, the device described in Perreault relies solely and entirely on a set of handles as the only means for turning a screw member of the hollow, external tubular member/sleeve, in which an umbrella post is inserted, to obtain insertion into the ground. Thus, any downward pressure for driving the tubular member into the ground while turning the screw must come entirely from the individual's arms and upper body strength. For younger individuals or those who are less muscularly developed the reliance solely and entirely on the set of handle can still prove too difficult a challenge to muster enough downward force in those cases where the ground is comprised of compact dirt or sand.

In another embodiment of Perreault, the screw member and handle are two separately detachable parts. As mentioned above the screw member may require additional tools to attach requiring more baggage and consuming more leisure time. Also in this embodiment, the handles rely solely on a frictional grip to grab the umbrella post. In many instances this solution may not prove secure enough to obtain the necessary force to insert the post into the ground. In other words, the handle portion always possesses the inherent possibility of slipping along the umbrella post from the force of any downward pressure applied to the handle set. These factors can further complicate any effort to insert, position, and stabilize the umbrella in the ground, again adding to the individual's inconvenience.

Another approach is provided in U.S. Pat. No. 5,482,246 to Derkoski. The Derkoski patent appears to provide improvements over the device described in the above patent to Perreault. In Derkoski, reference is made to the Perreault and other attempts at anchoring umbrellas into the ground in a secure manner. The Derkoski patent describes the prior art attempts as generally effective in securing an umbrella post into dirt, or into sand on calm days, but that they provide less than adequate results on windy days. Specifically, the Derkoski patent describes the prior art, such as Perreault, as susceptible to being easily ripped out of sand or loose dirt if an umbrella secured thereby is subjected to windy conditions. Accordingly, the Derkoski patent goes on to describe an anchoring device having an auger circumferentially disposed around the device. The auger preferably includes a radially outward edge which is upwardly curved to give the auger a generally scoop-shaped configuration in an effort to firmly hold earthen material. Nonetheless, the Derkoski device like the Perreault patent suffers from a number of inherent drawbacks.

In Derkoski, one embodiment is described as a shaft having a first longitudinal end, a second longitudinal end, and a given length, said second longitudinal end being adapted to accommodate a beach umbrella post. In other words, the anchoring device is separate from the umbrella. At least one handle is coupled to the separate shaft. A spiral-shaped member is connected to, and extends beyond the first longitudinal end of the shaft, and outwardly a first distance therefrom, to facilitate entry of the anchoring device into the ground. Further, an auger is disposed circumferentially around the shaft and has a curved bottom edge to facilitate entry of the auger into the ground, the auger having an upwardly curved radial outward edge to form a scooped-shaped configuration to firmly hold earthen material in a manner which restricts withdrawal of said auger from the ground. Also, the auger extends outwardly from the shaft a second distance greater than said first distance. And, a means is necessary for fastening the shaft to the umbrella post.

As mentioned above, this described embodiment suffers from a number of the same shortcomings described in connection with the Perreault device. That is, the Derkoski umbrella adds additional item(s) to the cumbersome baggage which the outdoor enthusiast already has to transport. Additionally, the device if metal can be quite weighty. Further, with just handles, the device still relies entirely on the arm strength of the user to provide the downward force, turning the spiral-shaped member and the auger into the ground. However, the addition of the auger to the Derkoski umbrella requires an additional magnitude of force to lodge the auger into the ground and creates an additional sharp edged protrusion which reduces the umbrellas compactness for ease of transport.

In another embodiment of Derkoski, the anchoring device is described as having the same components, but with all of the components being integral with the umbrella. While this embodiment may avoid the burden of having an additional members to carry, it still presents a cumbersome situation since the auger extends rather awkwardly from the umbrella making the overall diameter of the umbrella unsuited to transporting in a carrying case. This is further compounded by the fact that the handles in Derkoski are in no way retractable. In addition, the fact that the handles are not retractable presents the inconvenience that the handles can easily poke, snag, or otherwise interfere with a person moving or situated under and around the umbrella. Also, as before, the only mechanism for applying downward force and inserting the auger into the ground must come from arm strength applied to the handles.

Accordingly, as will be apparent from reading the above description, a structure for outdoor umbrellas is still needed which affords improved ability to secure the umbrella into the earth. A structure for an umbrella is desired which affords stability and flexible positioning of the umbrella, such as on an angle, while still being able to withstand stormy and windy conditions without being unearthed. Likewise, it is desirable that the improved umbrella structure be such that the umbrella is light and manageable to transport without requiring separate components or tools. And finally, it is desirable to develop an improved outdoor umbrella which incorporates all of the above traits and provides a means for inserting the umbrella into the ground without having to rely entirely on the arm strength of an individual and in which the insertion aid does not remain an obstacle or hindrance which could poke, snag or otherwise interfere with a person moving or situated under and around the umbrella.

SUMMARY OF THE INVENTION

A solution to the above described problems associated with earlier devices and methods for inserting, securing and flexibly positioning outdoor umbrellas into the ground will be known and understood by one of ordinary skill in the art upon reading and studying the following description. An improved umbrella with integral anchoring structure is provided. The improved device provides additional resistance to the umbrella toppling over under its own weight and from being unearthed in stormy and windy conditions. The device provides a means for facilitating the insertion of the anchoring structure into the ground without having to rely entirely on the arm strength of the individual. As will be clear from reading this disclosure, the insertion aid does not remain an obstacle or hindrance which could poke, snag or otherwise interfere with a person moving or situated under and around the umbrella when the umbrella is in use or when the umbrella is in transport. Additionally, the improved umbrella is light and manageable to transport without requiring separate components or tools.

One example of the present invention includes an umbrella with an integral anchoring structure. The umbrella includes a post having a lower end for insertion into the ground, and an upper end for supporting an umbrella top. The umbrella includes an integral spiral shaped anchoring structure formed on the lower end of the post. The anchoring structure is formed with a width, W, greater than a diameter of the post and a length, L, which is adapted to stabilize a weight of the umbrella and secure the umbrella and the post in a variety of earthen conditions such as sand, lawn, and soil even in a prevailing breeze or stormier conditions. The umbrella further includes one or more retractable levers integrally attached along the post which can lock and unlock to aid in inserting the umbrella into the ground and which do not remain an obstacle or hindrance which could poke, snag or otherwise interfere with a person moving or situated under and around the umbrella when the umbrella is in use or when the umbrella is in transport.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

In the following detailed description of the invention, reference is made to the accompanying drawings which form a part hereof, and in which is shown, by way of illustration, specific embodiments in which the invention may be practiced. The embodiments are intended to describe aspects of the invention in sufficient detail to enable those skilled in the art to practice the invention. Other embodiments may be utilized and changes may be made without departing from the scope of the present invention.

Figure 1:
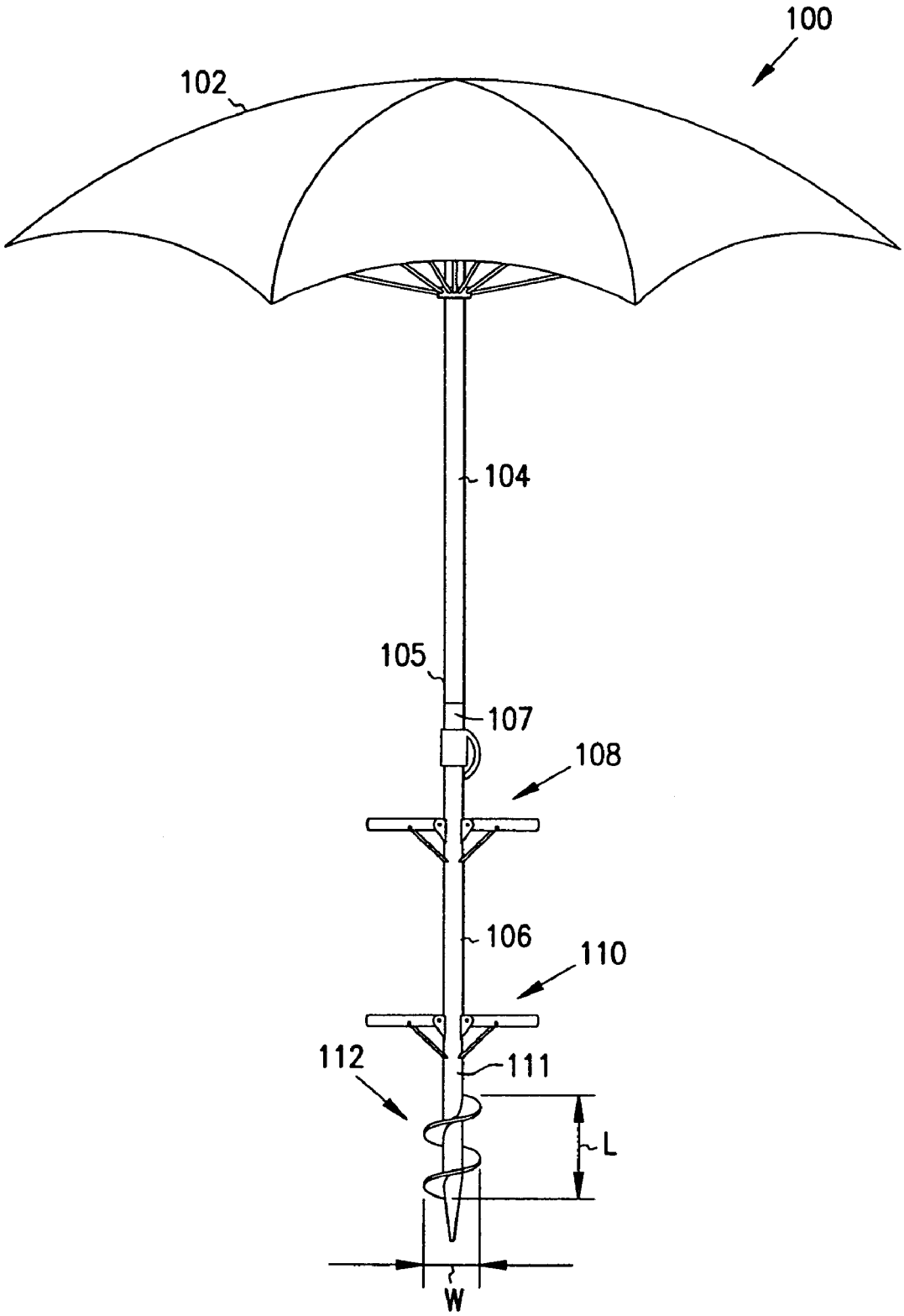
FIG. 1 illustrates an embodiment of an umbrella including an integral anchoring structure according to the teachings of the present invention.

FIG. 1 is a perspective view on an umbrella 100 including an integral anchoring structure according to the teachings of the present invention. As shown in FIG. 1, the umbrella includes an umbrella top 102 as the same are known and understood by those of ordinary skill in the art. For example, in one embodiment, the umbrella top 102 includes a conventional retractable umbrella top 102. The retractable umbrella top 102 is attached by know means to a post as the same will be know and understood by one of ordinary skill in the art upon reading this disclosure. According to the teachings of the present invention the post can include a single continuous post, or alternatively can include a sectional post having any number of sections such that the umbrella 100 can be broken down into sections for ease of transport. Each of these post embodiments will be recognized and understood by one of ordinary skill in the art upon reading this disclosure. For ease of reference, the remaining disclosure will make reference to an umbrella 100 having a post which can be sectioned into two parts. However, the invention is not so limited. FIG. 1 provides an illustration a two-sectional post embodiment for an umbrella 100.

In the embodiment shown in FIG. 1, the retractable umbrella top 102 is supported by and attached to an upper post 104 of the umbrella 100. As mentioned above, outdoor umbrellas generally include a sectional post such that the umbrella can be conveniently broken down into one or more sections for easier transport. Thus, by way of illustration and not by way of limitation, umbrella 100 includes an upper post portion 104 and a lower post portion 106. In one embodiment of use as will be recognized by one of ordinary skill in the art, the upper post portion 104 of a two-sectional post often is tapered at its lower end 105 so that the upper post can be inserted into an opening in an upper end 107 of the lower post portion 106 and thus rigidly clasp together. Such methods for attaching sectional posts for outdoor umbrellas are known and will be understood by one of ordinary skill in the art upon reading this disclosure. The invention is not so limited.

According to the teachings of the present invention and as shown in FIG. 1, the lower post 106 of the umbrella 100 includes one or more retractable levers, shown generally as 108 and 110, which are integrally attached to the post. The embodiment shown in FIG. 1, illustrates that the one or more retractable levers, 108 and 110, are integrally attached to the lower post 106. However, the invention is not so limited and the one or more retractable levers, 108 and 110, can anywhere along a length of the upper post 104 or the lower post 106. In FIG. 1, a first pair of retractable levers 108 are illustrated integrally attached to the lower post 106 near the upper end 107 of the lower post 106. In this disclosure the first pair of retractable levers 108 can serve as a pair of retractable arm levers 108. As will be explained in more detail below, one advantage of the one or more retractable arm levers 108 is that the arm levers 108 can be locked into a first position, shown in FIG. 1, perpendicular to the length of the umbrella post 106 to enable a user to apply downward pressure using their arms through a rotational, turning movement of the umbrella post 106 to obtain insertion of the lower post 106 into the ground. However, once the same is completed, the one or more retractable arm levers 108 can be unlocked or dislodged from the first position and retracted into a second position parallel to the length of the post 106, shown in FIG. 4, so that the one or more retractable arm levers 108 do not poke, snag, or otherwise interfere with a person moving or situated under and around the umbrella 100. Similarly, the one or more retractable arm levers 108 facilitate an ease of transport of the umbrella 100 once the same are retracted into the second position.

According to the teachings of the present invention and as shown in FIG. 1, a second pair of retractable levers 108 are illustrated integrally attached to the lower post 106 near the lower end 111 of the lower post 106. In this disclosure the pair of retractable levers 108 can serve as a pair of retractable foot levers, foot pedals, etc 108. As mentioned above, any number of retractable levers can be included. The invention is not limited to just a pair of retractable arm levers 108 or to just a pair of retractable foot levers 110. As will be explained in more detail below, one advantage of the one or more retractable foot levers 110 is that the foot levers 110 can be locked into a first position, shown in FIG. 1, perpendicular to the length of the umbrella post 106 to enable a user to apply downward pressure using their feet through a rotational, turning movement of the lower post 106 to obtain added downward force or assistance, in complement to the above described downward arm pressure, in order to facilitate insertion of the lower post into the ground. However, as before, one the same is completed, the one or more retractable foot levers 110 can be unlocked or dislodged from the first position and retracted into a second position parallel to the length of the umbrella post 106, shown in FIG. 6, so that the one or more retractable foot levers 110 do not poke, snag, or otherwise encumber a person moving or situated under and around the umbrella 100. Similarly, the one or more retractable foot levers 110 facilitate an ease of transport of the umbrella 100 once the same are retracted into the second position.

According to the teachings of the present invention and as shown in FIG. 1, the lower end 111 of the lower post 106 includes and integral anchoring structure 112. In the embodiment, shown in FIG. 1, the integral anchoring structure 112 includes an integral spiral shaped anchoring structure 112. In the invention, the integral spiral shaped anchoring structure aids and serves to facilitate an insertion of the lower post 106 into the ground and retention therein upon being so inserted. As one of ordinary skill in the art will understand upon reading this disclosure, the integrally formed spiral shaped anchoring structure 112 serves two purposes. One purpose includes an added ease for inserting the lower post 106 into the earth in conjunction with the above described rotational downward force enabled by the one or more retractable arm and foot levers, 108 and 110 respectively. This includes insertion of the integral spiral shaped anchoring structure into compact ground conditions whether the compact ground includes sand, lawn, soil or other earthen material. A second purpose includes the fact that the integral anchoring structure 112 is formed with a width, W, greater than a diameter of the post 106 and a length, L, which is adapted to stabilize a weight of the umbrella and secure the umbrella and the post in a variety of earthen conditions such as sand, lawn, and soil even in a prevailing breeze or stormier conditions. As one of ordinary skill in the art will understand upon reading this disclosure, the above described upper post section 104, lower post section 106, the integral anchoring structure 112, and the one or more retractable handles 108 and 110 can be formed from a material selected from the group consisting of wood, metal, or rigid plastic. According to the teachings of the present invention, the ability to fabricate the above recited components of the invention from the same or similar materials provides for a streamlined manufacturing process and reduces manufacturing costs. As one of ordinary skill in the art will understand upon reading this disclosure, a number of shapes and structural designs for the upper post section 104, lower post section 106, the integral anchoring structure 112, and the one or more retractable handles 108 and 110 are suited to the teachings of the present invention. Some are presented here for ease of illustration, but the invention is not so limited. The invention is to be defined by the aspects, advantages, and features of included claims and equivalents thereof. Hence, by way of example, the integral anchoring structure 112 includes variants on the illustrated integral spiral shaped anchoring structure 112 to embrace other spiral shaped configurations or auger like structures as limited only by the description contained herein.

As mentioned above, the integral components of the present invention, e.g. including the upper post section 104, lower post section 106, the integral anchoring structure 112, and the one or more retractable handles 108 and 110, can be formed from a number of commercially suited materials. Thus, according to one embodiment of the invention, the above described integrally connected components are formed of rigid plastic, such as injection molded plastic, which can be easily fabricated. However, in other embodiments, other materials such as wood and metal are conceived within the scope of the present invention to form the components, or any combination thereof. As one of ordinary skill in the art will understand upon reading this disclosure, the integrally connected structure of the present invention affords an added level of convenience for the transport of the umbrella 100 of the present invention since the user does not have to keep track of multiple, separate pieces or components. Further, as one of ordinary skill in the art will understand upon reading this disclosure, the integral anchoring structure 112 is formed with a width, W, greater than a diameter of the post 106 and a length, L, which is adapted to stabilize the weight of the umbrella and secure the same in a variety of earthen conditions such as sand, lawn, and soil, even in a prevailing breeze or stormier conditions. But also, notably as discussed in more detail below, the integral anchoring structure 112 is formed with a width, W, and a length, L, which are reasonably scaled such that these dimensions facilitate an ease of transport for the umbrella 100 within an umbrella carrying case. As such, the width, W, and a length, L, of the integral anchoring structure 112 do not present the cumbersome, protruded, and bulky dimensions exhibited in many prior art approaches. The features of the present invention obviate a need for these cumbersome, protruded, and bulky dimensions by the features and instrumentalities of the present inventions advantageous design.

Figure 2:
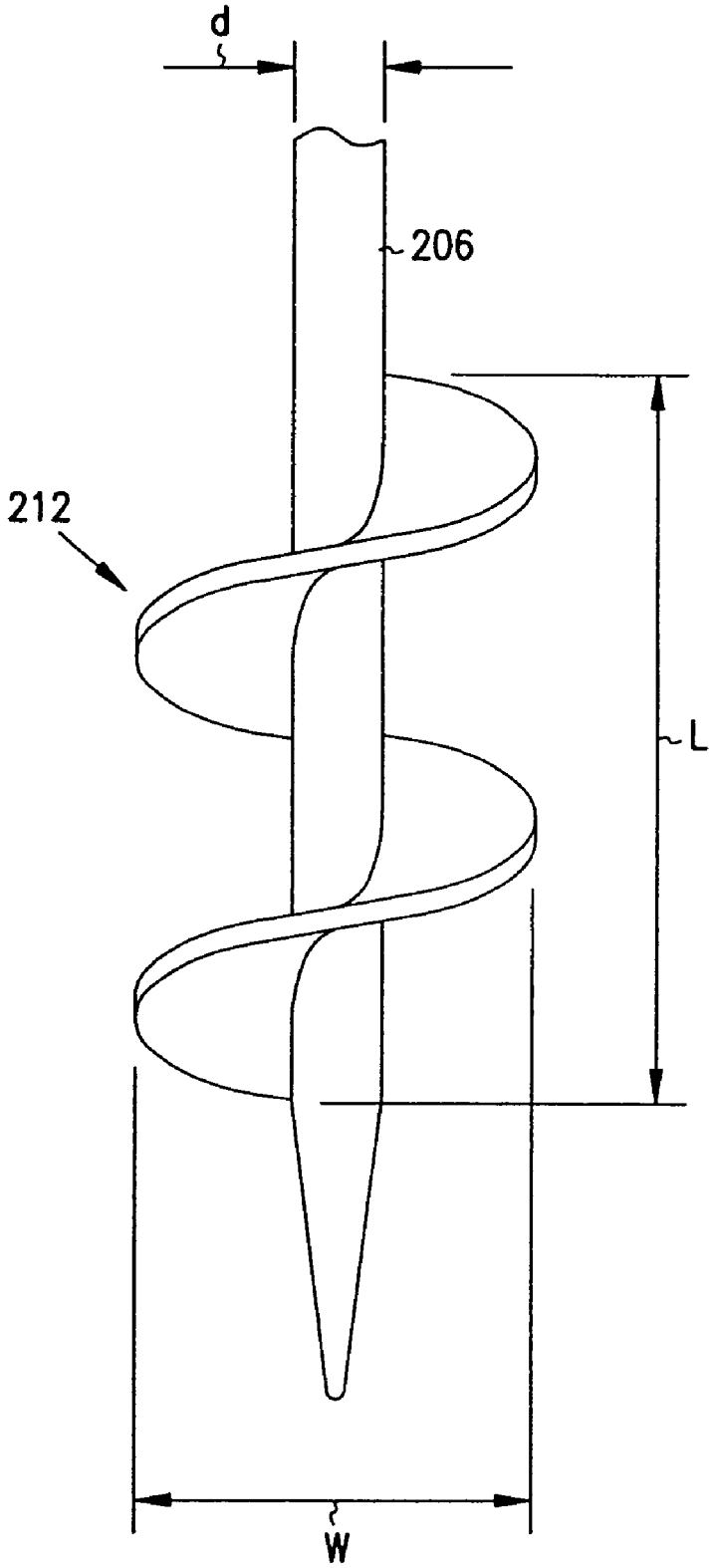
FIG. 2 illustrates an embodiment of an integral anchoring structure from FIG. 1 according to the teachings of the present invention.

FIG. 2 illustrates an embodiment of an integral anchoring structure 112 from FIG. 1 according to the teachings of the present invention. That is FIG. 2 illustrates, in enlarged detail, one embodiment of the integral anchoring structure 212 formed on the lower end of the post 206. FIG. 2 is useful for better illustrating an embodiment of the width, W, and length, L, dimensions of the anchoring structure 212 according to the teachings of the present invention. For example, in one embodiment of the present invention, the umbrella post 206 has a diameter, d, of approximately 1–2 inches as are generally found with conventional outdoor umbrellas. In this embodiment, the integral spiral shaped anchoring structure 212 will have a width, W, of approximately two to three times the diameter of the umbrella posts 204 and 206. That is, the integral spiral shaped anchoring structure will have a width, W, of approximately 2–6 inches. As one of ordinary skill in the art will understand upon reading this disclosure, such a width, W, is well suited for grasping and holding earthen material while at the same time not creating such a protrusion on the end of the umbrella so as to inhibit the transport or the storage of the umbrella post 206 having the integral anchoring structure within an umbrella carrying case. Instead, the umbrella post 206 having the integral anchoring structure can be transported and stored with the same amount of ease as a conventional umbrella.

According to the teachings of the present invention, the length, L, of the integral spiral shaped anchoring structure 212 has a vertical length of approximately 3 to 12 inches. As one of ordinary skill in the art will understand upon reading this disclosure, such a length, L, is well suited for providing a deep enough penetration of the anchoring structure 212 and post into the ground for securely grasping and holding earthen material in a variety of earthen conditions such as sand, lawn, and soil, even in a prevailing breeze or stormier conditions, while at the same time not creating such a protrusion on the end of the umbrella so as to inhibit the transport or the storage of the umbrella post 206 having the integral anchoring structure within an umbrella carrying case or elsewhere. As noted above, in one embodiment, the integral anchoring structure 212 is formed from rigid plastic, e.g. injection molded plastic, such that the umbrella remains light in weight and does not present a clunky, dangerous, or protrusive structure. The above is provided as an illustrative example only of one or more embodiments for the present invention and is not to be taken in a limiting sense. One of ordinary skill in the art will understand upon reading this disclosure that other widths, W, and lengths, L, are included within the scope of the present invention in order to achieve the desired results set forth herein and are limited only by the description of the desired results contained herein.

One advantage afforded by the above described embodiment, and which is intended in all embodiments of the invention, is to have a width, W, and length, L, for the integral spiral shaped anchoring structure 212 which is not unduly cumbersome or obtrusive such that the anchoring structure 212 becomes unwieldy for transport and storage, e.g. storage in an umbrella carrying bag. At the same time, the above described embodiments for width, W, and length, L, to the integral anchoring structure 212 will facilitate an ease of insertion of the anchoring structure 212 and post 206 into the ground. Additionally the above described embodiments for width, W, and length, L, to the integral anchoring structure 212, when inserted into the ground, will provide added resistance to the umbrella toppling over under its own weight, or being retracted unintentionally from the ground under breezy or stormy conditions, e.g. wind gust. Further, the integral anchoring structure 212 further provides flexibility in desirably positioning the umbrella 100 for maximal shade, e.g. at an angle, which provides additional convenience for the user.

Figure 3:
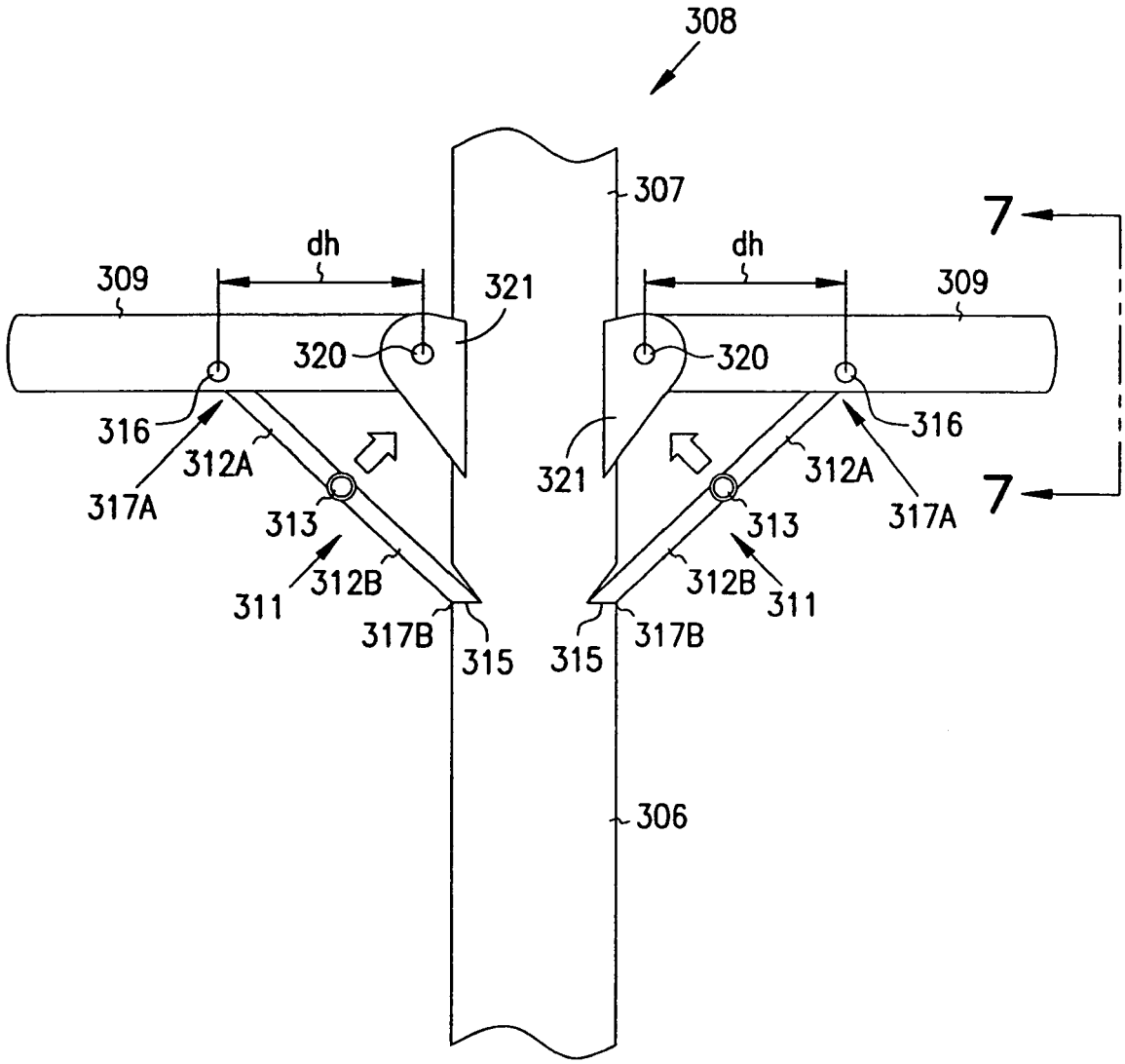
FIG. 3 illustrates in greater detail a first pair of retractable levers locked in a first position, as also shown in FIG. 1, according to the teachings of the present invention.

FIG. 3 illustrates in greater detail a first pair of retractable levers 308 locked in a first position according to the teachings of the present invention. That is, FIG. 3 illustrates, in enlarged detail, one embodiment of the one or more arm levers shown as 108 in FIG. 1. The embodiment shown in FIG. 3 illustrates a pair of retractable arm levers 308 integrally formed on opposite sides of the lower post 306 near the upper end 307 of the lower post 306 for applying a rotational, downward force, using the arms, for inserting the lower post 306 and integral anchoring structure described above into the ground. In one embodiment of the invention, the lower end of the post 306 narrows to a point at the very bottom of the post 306. As shown in FIG. 3, in one embodiment the pair of retractable arm levers 308 include a pair of arm handles, or hand posts, grips, etc. 309 which are pivotally connected at one end respectively to the to the upper end 307 of the lower post 306. In the embodiment shown in FIG. 3, the pair of arm handles are pivotally connected to the post 306 by a pin 320. As shown in FIG. 3 the pin passes through a set of protruded members 321 on one side of the post 306 (e.g. a "dog ear"), which in this embodiment is integrally formed to the post, through the arm handles 309, and then through a complimentary set of protruded members (not shown) on the other side of the post 306. As one of ordinary skill in the art will recognize upon reading this disclosure, the protruded members 321 can be formed of the same material as the post, e.g. injection molded plastic members 321. Also, as one of ordinary skill in the art will understand upon reading this disclosure, the pin 320 can include an aluminum, or other metal alloy pin 320, or even plastic. The invention is not so limited. One of ordinary skill in the art will understand upon reading this disclosure, the manner in which such a described pin 320 can be passed through the set of protruded members 321 on one side of the post 306, through the arm handles 309, and then through a complimentary set of protruded members on the other side of the post 306 and affixed to the protruded members 321 such that the arm handles 309 are pivotally connected to the post 306. One of ordinary skill in the art will further appreciate and understand upon reading this disclosure that these described components and their formation provide for a streamlined and cost efficient fabrication process, and even more so in an embodiment in which the pair of arm handles are similarly formed of the same material as the post 306.

According to the teachings of the present invention, the pair of arm handles 309 with their pivotal connection to the post 306 are actionable through a range of motion. That is, in this embodiment, the pair of arm handles can rotate about the pivotal connection, provided by the pin 320 and the protruded members, between a first position shown in FIG. 3 and a second position shown subsequently in FIG. 4. In FIG. 3, the arm levers 308 are shown with the arm handles 309 locked in a first position, perpendicular to a length of the lower post 306 to enable a user to apply downward pressure, using their arms, to the post 306 for inserting the post 306 into the ground. Further, as will be understood by one of ordinary skill in the art upon reading this disclosure and as described in more detail herein, the arm handles 309, locked in the first position, enable a user to apply downward pressure to the post 306 through a rotational, turning movement of the arm handles 309 and consequently the post 306 to facilitate and obtain an easier insertion of the lower post 306 and its complimentary, integral spiral shaped anchoring structure into the ground even in compact earthen conditions.

In one embodiment according to the teachings of the present invention, at least one of the one or more retractable arm levers 309 pivotally connected to the lower post section further includes an actionable hinged portion 311, or member, which is pivotally connected at one end to the at least one retractable arm lever 309 a distance from the pivotal connection of the retractable arm lever 309 to the lower post 306. In one embodiment, as explained in more detail below, the actionable hinged portion 311 includes a single continuous rigid member 311. In another embodiment, as shown in FIG. 3, the actionable hinged portion 311 includes an actionable hinged portion 311 having two rigid members connected together at a first end of the two rigid members. In this embodiment, a first one of the two rigid members is pivotally connected at its second end to the retractable handle 309 a distance, dh, from the pivotal connection 320 of the retractable handle 309 to the lower post section 306 and the two rigid members are connected together at the first end of each by a pin.

As shown in the embodiment of FIG. 3, each of the arm levers 308 includes an actionable hinged portion 311, respectively. In this embodiment, from the aligned position of the two rigid members shown in FIG. 3 the two rigid members can hinge act their connection in only one direction, as indicated by the arrow, toward the pivotal connection 320 of the arm handles 309 to the post 306. The actionable hinged portion 311 includes a two rigid members, 312A and 312B, connected together at a first end 313 of the two rigid members 312A and 312B. As explained in more detail below in connection with one embodiment shown in FIGS. 8A–8E, the two rigid members 312A and 312B can hinge at their connection 313 in only one direction, from the aligned state of the two rigid members 312A and 312B shown in FIG. 3, inward toward the post 306 and upward toward the pivotal connection 320 of the arm handles 309 to the post 306. According to the teachings of the present invention, when the two rigid members 312A and 312B are aligned, as shown in FIG. 3, the two rigid members are locked at their connection 313 from hinging any further, e.g. in a direction outward from the post 306 and downward away from the pivotal connection of the arm handles 309 to the post.

As shown in the embodiment of FIG. 3 and as discussed in more detail below, the two rigid members, 312A and 312B, are connected together at a first end by a hinge 313. One of ordinary skill in the art will understand upon reading this disclosure that the hinge 313 can include a pin 313, as described above, passing through interleaved portions of the two rigid members, 312A and 312B. More detail of one such embodiment is provided in connection with FIGS. 8A–8E below. However, one of ordinary skill in the art will understand upon reading this disclosure that the actionable hinged portion 311 is capable of rigidly aligning the two rigid members, 312A and 312B, when the arm handles 309 are in the first position, as shown in FIG. 3, such that the arm handles 309 can be locked. Thus, one of ordinary skill in the art will understand that the actionable hinged portion 311 can include other actionable hinged portion 311 configurations or structural designs, e.g. a spring hinge. The invention is not so limited. The invention is to be defined by the aspects, advantages, and features of included claims and equivalents thereof. What is important, however, is that the two rigid members, 312A and 312B in the embodiment of FIG. 3, or that a single continuous rigid member serving as the actionable hinged portion 311 in alternative embodiments, can lock when the arm handles 309 are in the first position.

In the embodiment of FIG. 3, the two rigid members 312A and 312B are hinged together in the middle of the two rigid members 312A and 312B. A first one 312A of the two rigid members 312A and 312B is further pivotally connected at its second end 317A to a portion on the arm handle 309 a distance, e.g. distance dh, from the pivotal connection 320 of the arm member 309 to the lower post 306. One of ordinary skill in the art will understand from reading this disclosure that the pivotally connection of a first one 312A of the two rigid members, 312A and 312B, at its second end 317A to the arm handles can be achieved using a pin 316, as described above. That is, in one embodiment, the arm handles include a hollow underbelly, as shown in the cross sectional view embodiment of FIG. 7, such that the second end 317A of the first one 312A of the two rigid members, 312A and 312B, can fit underneath the arm handles 309 within the hollow underbelly. In this embodiment, the pin 316, passes through one side of the arm handles 309, through the second end 317A of the first one 312A of the two rigid members, 312A and 312B, and through the other side of the arm handles 309. The pin 316 can be formed of similar materials as those described for pin 320 above and can be affixed to the two sides of the arm handles 309 as described above for pin 320 to provide rotational movement of the actionable hinged portion 311 through a range of motion about pin 316.

In order to facilitate the same, a second end 317B of a second one 312B of the two rigid members 312A and 312B in the embodiment of FIG. 3, or a second end of a single continuous rigid member serving as the actionable hinged portion 311 in alternative embodiments, is freely slidable along the lower post 306. In the embodiment of FIG. 3, when the arm handle 309 is in the first position, fully perpendicular to the lower post 306, the first and the second ones, 312A and 312B, of the two rigid members are aligned, and the second end 317B of the second one 312B one of the two rigid members 312A and 312B can be forced into an integral groove 315 in the lower post 306. These integral grooves 315 in the lower post 306 are shown in FIG. 3 on opposite sides of the post 306 underneath the arm handles 309. One of ordinary skill in the art will appreciate and understand upon reading this disclosure that an end of a single continuous rigid member serving as the actionable hinged portion 311 will similarly be seated into the internal groove 315 of the post, according to the teachings of the present invention. In such an alternative embodiment, the two rigid members 312A and 312B of the embodiment of FIG. 3, and their connection 313, are replaced by a single continuous rigid member serving as the actionable hinged portion 311.

By way of illustration, and not by way of limitation, the arm handles have a length of approximately 6 inches. The first one 312A of the two rigid members 312A and 312B is further pivotally connected at its second end 317A to a portion on the arm handle 309 a distance, dh, of approximately 3 inches from the pivotal connection 320 of the arm member 309 to the lower post 306. The integral grooves 315 in the post 306 are located a distance of approximately 3 inches below the pivotal connection of the arm member 309 to the post 306. And, the actionable hinged portion, including the two rigid members 312A and 312B, is approximately 3 inches. As one of ordinary skill in the art will understand upon reading this disclosure, the second end 317B of the second one 312B one of the two rigid members 312A and 312B can be seated in the integral grooves when the arm handles 309 are in the first position, shown in FIG. 3, and the two rigid members are aligned. As FIG. 3 illustrates, the configuration of this embodiment forms essentially an equilateral triangle shape between the actionable hinged portion 311, the post 306, and the arm handles 309 and the actionable hinged portion 311 is at a 45 degree angle to the post 306.

Again, the above lengths and distances are given by way of example and not by way of limitation. One of ordinary skill in the art will fully understand that other lengths for the arm handles, distances of connection of the second end 317A of the first one 312A of the two rigid members, 312A and 312B, to the arm handles from the pivotal connection 320 of the arm handles 309 to the post 306, and for the distance at which the integral grooves 315 are located beneath the pivotal connection 320 of the arm handles 309 to the post 306 are included within the scope of the invention. That is, a resulting configuration between the actionable hinged portion 311, the post 306, and the arm handles 309 for another embodiment of the invention can form a relationship which is not an equilateral triangle in shape and for which the actionable hinged portion 311 is at an angle greater than or less than 45 degrees in reference to the post 306. As one of ordinary skill in the art will understand upon reading this disclosure such adjustments can be made and still achieve the inventive feature of locking the arm handles 309 approximately perpendicular to the post 306 when in the first position while seating the second end 317B of the second one 312B of the two rigid members, or an end of a single continuous rigid member serving as the actionable hinged portion 311 in alternative embodiments, into the integral groove 315 in the post 306. One of ordinary skill in the art will further understand upon reading this disclosure that the integral grooves 315 can be replaced by an integral seat, or the like, extending outward from the post 306 rather than the groove extending inward. The invention is not so limited.

From the example embodiment described above and according to the invention when the arm handles are in the first position perpendicular to the post, the two rigid members can be locked in alignment (one embodiment of the actionable hinged portion 311, or locking means 311, is detailed below in connection with FIG. 8A–8E) and the second end 317B of the second one 312B of the two rigid members, 312A and 312B can be positioned or seated in the internal groove 315 of the post. One of ordinary skill in the art will further understand upon reading this disclosure that other equivalent actionable hinged portions, or locking means 311, are intended within the scope of the present invention. In this arrangement, a user can apply a downward force and turning, rotational force to the arm handles which maintains the rigid alignment of the two rigid members, 312A and 312B, forcibly seats the second end 317B of the second one 312B of the two rigid members, 312A and 312B, into the integral groove 315, and transfers the downward force applied to the arm handle 309 along the now fixedly aligned rigid members 312A and 312B and forcefully from the second one 312B of the two rigid members 312A and 312B into the groove 315. This downward and rotational transference of force is further applied downward along the lower post 306 driving the lower end of the post and the integral anchoring structure into the ground.

As mentioned above, the actionable hinged portion 311 is designed such that the two rigid members, 312A and 312B can only rotate from the aligned state in shown in FIG. 3 in one direction around their connection 313 at their respective first ends. According to the teachings of the present invention, each one of the two rigid members, 312A and 312B, can rotate through a range of motion of 180 degrees toward the other one of the two rigid members, 312A and 312B while the other one is held in place. Thus the two rigid members, 312A and 312B, can hinge from the fixedly and rigidly aligned state, e.g. when the arm handles 309 are in the first position of FIG. 3, to collectively rotate through a range of motion of 180 degrees allowing the two rigid members, 312A and 312B, to collapse toward one another until the two rigid members, 312A and 312B come to rest parallel to one another and bring the arm handles to rest in a second position parallel to a length of the post 306. As explained next in connection with FIG. 4, this occurs with the simple application of thumb pressure in the direction shown by the arrow in FIG. 3, e.g. an upward pressure at connection 313 in the direction inward toward the post 306 and upward toward the pivotal connection 320 of the arm handles 309 to the post 306. The reciprocal motion occurs for bringing the arm handles 309 from the second position parallel to the length of the post 306 to the first position perpendicular to the length of the post.

The above description illustrates one example of the manner in which the arm handles 309 can be locked into a first position perpendicular to a length of the post 306. However, the invention is not so limited. That is, in another embodiment of the present invention the actionable hinged portion 311 is replaced by a single continuous rigid member formed on any of the materials described above, e.g. rigid injection molded plastic, or equivalents thereof. In this embodiment, a first end is pivotally connected to the arm handles 309 as described above and a second end of the single continuous rigid member is freely slidable along the post 306 and can be positioned to seat in the integral groove 315 or integral seat extending outward from the post 306. However, as one of ordinary skill in the art will understand upon reading this disclosure, when the single continuous rigid member is unseated from the integral groove 315 the single continuous rigid member can freely drop in a pivotal motion around the pin 320 to a position parallel to the length of the post 306 to allow the arm handles 309 to collapse to a second position parallel to the length of the post 306. This second collapsed position of the arm handles 309 parallel to the length of the post 306 is shown next in FIG. 4.

Figure 4:
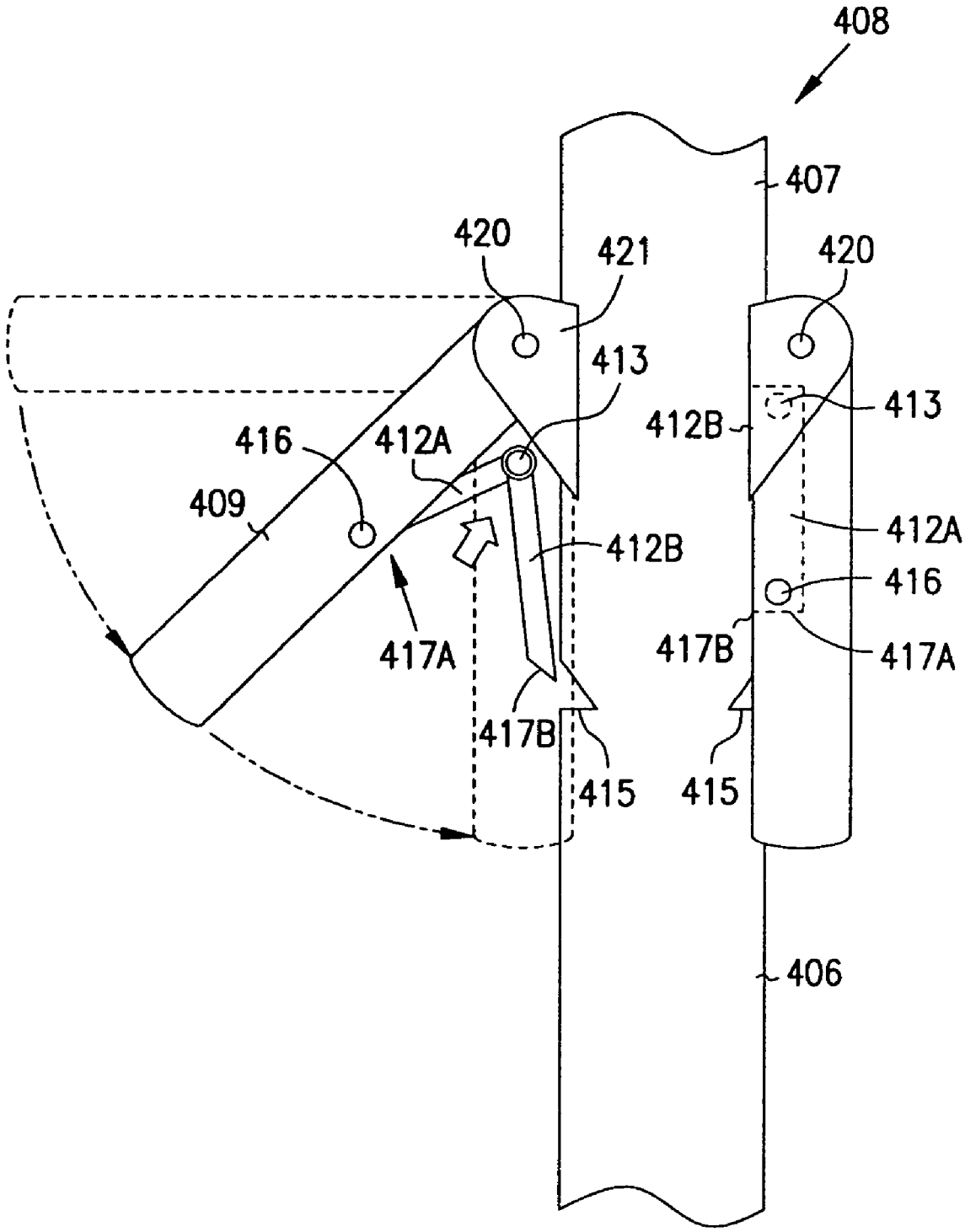
FIG. 4 illustrates the first pair of retractable levers from FIG. 3 in both a retractable motion and in a second position parallel to a post of the umbrella according to the teachings of the present invention.

FIG. 4 illustrates the first pair of retractable levers 408 in both a retractable motion and in a second position parallel to the post 406 of the umbrella according to the teachings of the present invention. In FIG. 4, the arm handles 409 are shown rotatably moving through 90 degrees to finally rest in a second, unengaged position parallel position to the lower post 406. Again, according to one embodiment described in connection with FIG. 3, the range of motion of the arm handles 409 is actuated as easily as applying an upward force, e.g. using a finger or thumb, to the middle hinge 413 to disengage the hinged alignment, end to end, of the two rigid members 412A and 412B. As the arm handles 409 are released and rotated downward about their pivotal connection 420 to the post 406, the two rigid members can collectively rotate through a range of motion of 180 degrees about their pivotal connection 413 allowing the two rigid members to collapse toward one another until the two rigid members, 412A and 412B come to rest parallel to one another and the arm handles 409 come to rest in a second position parallel to a length of the post 406. As one of ordinary skill in the art will understand upon reading this disclosure, the action described herein allows the freely slidable second end 417B of the second one 412B of the two rigid members 412A and 412B to releasably disengage from the integrally formed groove 415 in the lower post 406 and freely slides upward as the first one 412A of the two rigid members 412A and 412B collapses inward and pivots about its pivotal connection 416 with the arm handles 409 and folds flat against the length of the second one 412B the two rigid members 412A and 412B. Alternatively, as mentioned above, if the actionable hinged portion were replaced with the a single continuous rigid member one end of the single rigid member would be unseated from the integral groove 415 and allowed to freely slide and drop downward along the post 406 while the other end of the single continuous rigid member rotated about its pivotal connection 416 with the arm handles, again allowing the arm handles 409 to rotate downward until coming to rest parallel to the length of the post 406 in the second position. FIG. 4 thus illustrate an inventive aspect of the invention in illustrating the arm handles 409 of the arm levers 408 retracted into a second position parallel to the lower post 406 so that the one or more retractable arm levers 408 do not poke, snag, or otherwise encumber a person moving or situated under and around the umbrella when the umbrella is in use. Similarly, another advantageous feature afforded by the present invention is that the one or more retractable arm levers 408 facilitate an ease of transport and storage, such as in an umbrella carrying case, once the same are retracted into the second position. Also, as one of ordinary skill in the art will understand upon reading this disclosure, a reciprocal motion to that described above will return the arm handles 409 from the second position parallel to the length of the post to a first position perpendicular to a length of the post 406 such that the second end 417B of the second one 412B of the two rigid members 412A and 412B can be reseated into the integral groove 415 for use of the arm handles 409.

Figure 5:
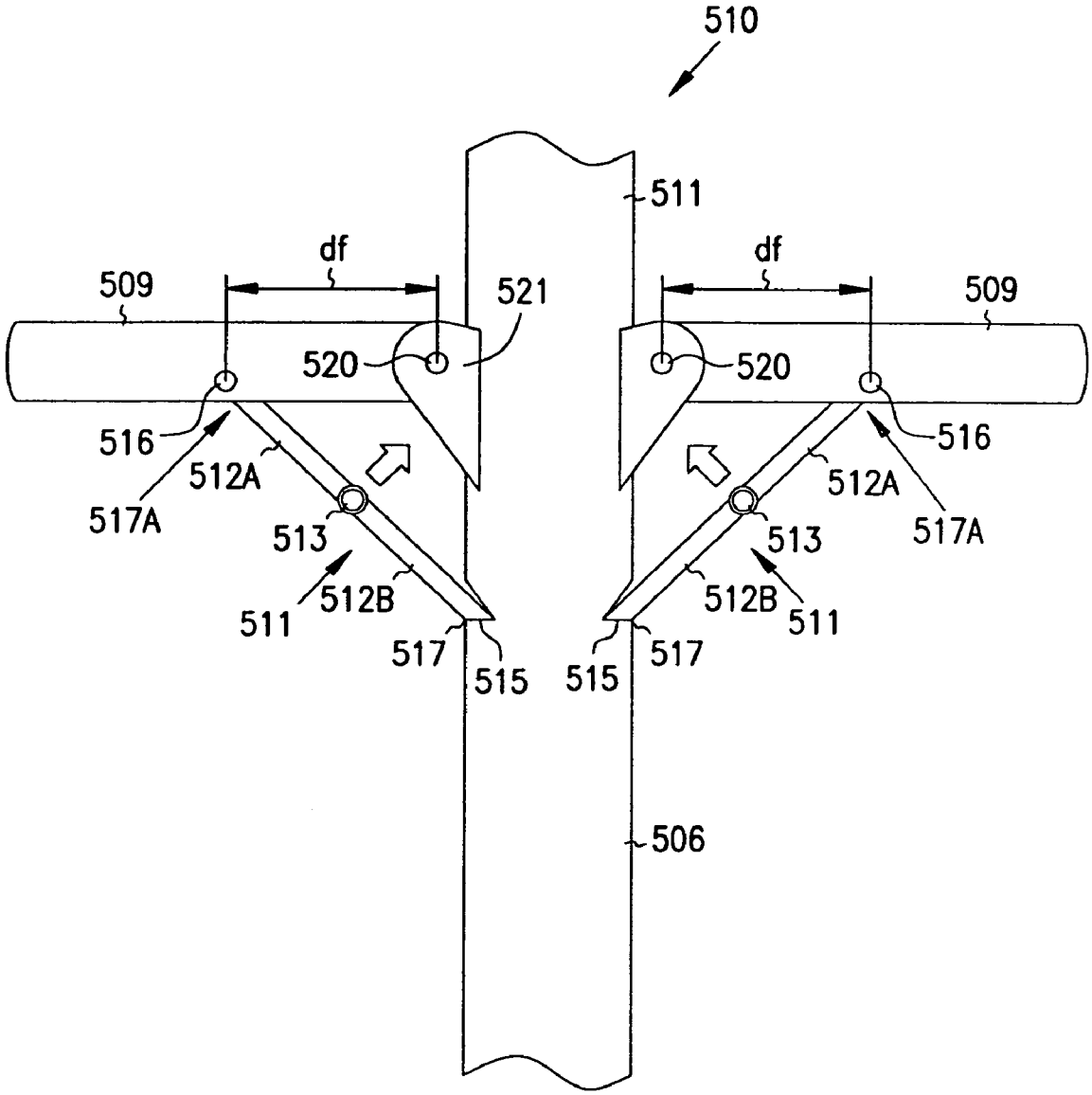
FIG. 5 illustrates in greater detail a second pair of retractable levers locked in a first position, as also shown in FIG. 1, according to the teachings of the present invention.

FIG. 5 illustrates in greater detail a second pair of retractable levers 510 locked in a first position according to the teachings of the present invention. That is, FIG. 5 illustrates, in enlarged detail, one embodiment of the one or more foot levers shown as 110 in FIG. 1. The embodiment shown in FIG. 5 illustrates a pair of retractable foot levers 510 integrally formed on opposite sides of the lower post 506 near the lower end 511 of the lower post 506, above the integral anchoring structure, for applying a rotational, downward force, using the feet, for inserting the lower post 506 and integral anchoring structure described above into the ground. In one embodiment of the invention, the lower end of the post 506 narrows to a point at the very bottom of the post 506. As shown in FIG. 5, in one embodiment the pair of retractable foot levers 510 include a pair of foot handles, or foot pegs, posts, grips, etc. 509 which are pivotally connected at one end respectively to the to the lower end 511 of the lower post 506. In the embodiment shown in FIG. 5, the pair of foot handles are pivotally connected to the post 506 by a pin 520. As shown in FIG. 5 the pin passes through a set of protruded members 521 on one side of the post 506 (e.g. a "dog ear"), which in this embodiment is integrally formed to the post, through the foot handles 509, and then through a complimentary set of protruded members (not shown) on the other side of the post 506. As one of ordinary skill in the art will recognize upon reading this disclosure, the protruded members 521 can be formed of the same material as the post, e.g. injection molded plastic members 521. Also, as one of ordinary skill in the art will understand upon reading this disclosure, the pin 520 can include an aluminum, or other metal alloy pin 520, or even plastic. The invention is not so limited. One of ordinary skill in the art will understand upon reading this disclosure, the manner in which such a described pin 520 can be passed through the set of protruded members 521 on one side of the post 506, through the foot handles 509, and then through a complimentary set of protruded members on the other side of the post 506 and affixed to the protruded members 521 such that the foot handles 509 are pivotally connected to the post 506. One of ordinary skill in the art will further appreciate and understand upon reading this disclosure that these described components and their formation provide for a streamlined and cost efficient fabrication process, and even more so in an embodiment in which the pair of foot handles 509 and the pin 520 are similarly formed of the same material as the post 506.

According to the teachings of the present invention, the pair of foot handles 509 with their pivotal connection to the post 506 are actionable through a range of motion. That is, in this embodiment, the pair of foot handles can rotate about the pivotal connection, provided by the pin 520 and the protruded members, between a first position shown in FIG. 5 and a second position shown subsequently in FIG. 6. In FIG. 5, the foot levers 510 are shown with the foot handles 509 locked in a first position, perpendicular to a length of the lower post 506 to enable a user to apply downward pressure, using their feet, to the post 506 for inserting the post 506 into the ground. Further, as will be understood by one of ordinary skill in the art upon reading this disclosure and as described in more detail herein, the foot handles 509, locked in the first position, enable a user to apply downward pressure to the post 506 through a rotational, turning movement of the foot handles 509 and consequently the post 506 to facilitate and obtain an easier insertion of the lower post 506 and its complimentary, integral spiral shaped anchoring structure into the ground even in compact earthen conditions. Thus, as described herein, the action of the second pair of retractable levers 510 is similar to that described above in connection with FIGS. 3 and 4 for the first pair of retractable levers.

In one embodiment, as shown in FIG. 5, each of the foot levers 510 includes an actionable hinged portion 511, respectively. In one embodiment, as described above, the actionable hinged portion 511 includes a single continuous rigid member 511 which has a hinged connection to the foot handles 509. However, in the embodiment shown in FIG. 5, the actionable hinged portion 511 includes two rigid members which are connected together at one end by another hinge. In the embodiment shown in FIG. 5, the two rigid members 512A and 512B can hinge in only one direction, from the aligned state when the foot handles are perpendicular to the length of the post 506, toward the pivotal connection 520 of the foot handles 509 to the post 506. The actionable hinged portion 511 includes a two rigid members, 512A and 512B, connected together at a first end 513 of the two rigid members 512A and 512B. As explained in more detail below in connection with one embodiment shown in FIGS. 8A–8E, the two rigid members 512A and 512B can hinge at their connection 513 in only one direction, from the aligned state when the foot handles 509 are perpendicular to the length of the post 506, inward toward the post 506 and upward toward the pivotal connection 520 of the foot handles 509 to the post 506 as shown by the arrow. According to the teachings of the present invention, when the two rigid members 512A and 512B are aligned, as shown in FIG. 5, the two rigid members are locked at their connection 513 from hinging any further, e.g. in a direction outward from the post 506 and downward away from the pivotal connection of the foot handles 509 to the post, e.g. opposite the arrow.

As shown in the embodiment of FIG. 5 and as discussed in more detail below, the two rigid members, 512A and 512B, are connected together at a first end by a hinge 513. One of ordinary skill in the art will understand upon reading this disclosure that the hinge 513 can include a pin 513, as described above, passing through interleaved portions of the two rigid members, 512A and 512B. More detail of one such embodiment is provided in connection with FIGS. 8A–8E below. However, one of ordinary skill in the art will understand upon reading this disclosure that the actionable hinged portion 511 is capable of rigidly aligning the two rigid members, 512A and 512B, when the foot handles 509 are in the first position, as shown in FIG. 5, such that the foot handles 509 can be locked. Thus, one of ordinary skill in the art will understand that the actionable hinged portion 511 can include other actionable hinged portion 511 configurations or structural designs, e.g. a spring hinge. The invention is not so limited. The invention is to be defined by the aspects, advantages, and features of included claims and equivalents thereof. What is important, however, is that the two rigid members, 512A and 512B, or the single continuous rigid member serving as the actionable hinged portion 511 in other embodiments, can lock when the foot handles 509 are in the first position.

Thus, in the embodiment of FIG. 5 the two rigid members 512A and 512B are hinged together in the middle of the two rigid members 512A and 512B. A first one 512A of the two rigid members 512A and 512B is further pivotally connected at its second end 517A to a portion on the foot handle 509 a distance, e.g. distance df, from the pivotal connection 520 of the foot handle 509 to the lower post 506. One of ordinary skill in the art will understand from reading this disclosure that the pivotally connection of a first one 512A of the two rigid members, 512A and 512B, at its second end 517A to the foot handles can be achieved using a pin 516, as described above. That is, in one embodiment, the foot handles include a hollow underbelly, as shown in the cross sectional view embodiment of FIG. 7, such that the second end 517A of the first one 512A of the two rigid members, 512A and 512B, can fit underneath the foot handles 509 within the hollow underbelly. In this embodiment, the pin 516 passes through one side of the foot handles 509, through the second end 517A of the first one 512A of the two rigid members, 512A and 512B, and through the other side of the foot handles. The pin 516 can be formed of similar materials as those described for pin 520 above and can be affixed to the two sides of the foot handles 509 as described above for pin 520 to provide rotational movement of the actionable hinged portion 511 through a range of motion about pin 516.

In order to facilitate the same, a second end 517B of a second one 512B of the two rigid members 512A and 512B is freely slidable along the lower post 506. However, when the foot handle 509 is in the first position, fully perpendicular to the lower post 506, the first and the second ones, 512A and 512B, of the two rigid members are aligned, and the second end 517B of the second one 512B one of the two rigid members 512A and 512B can be forced into an integral groove 515 in the lower post 506. These integral grooves 515 in the lower post 506 are shown in FIG. 5 on opposite sides of the post 506 underneath the foot handles 509.

By way of illustration, and not by way of limitation, the foot handles have a length of approximately 6 inches. The first one 512A of the two rigid members 512A and 512B is further pivotally connected at its second end 517A to a portion on the foot handle 509 a distance, df, of approximately 3 inches from the pivotal connection 520 of the foot member 509 to the lower post 506. The integral grooves 515 in the post 506 are located a distance of approximately 3 inches below the pivotal connection of the foot handle 509 to the post 506. And, the actionable hinged portion, including the two rigid members 512A and 512B, is approximately 3 inches. As one of ordinary skill in the art will understand upon reading this disclosure, the second end 517B of the second one 512B one of the two rigid members 512A and 512B can be seated in the integral grooves when the foot handles 509 are in the first position, shown in FIG. 5, and the two rigid members are aligned. As FIG. 5 illustrates, the configuration of this embodiment forms essentially an equilateral triangle shape between the actionable hinged portion 511, the post 506, and the foot handles 509 and the actionable hinged portion 511 is at a 45 degree angle to the post 506.

Again, the above lengths and distances are given by way of example and not by way of limitation. One of ordinary skill in the art will fully understand that other lengths for the foot handles 509, distances of connection of the second end 517A of the first one 512A of the two rigid members, 512A and 512B, to the foot handles 509 from the pivotal connection 520 of the foot handles 509 to the post 506, and for the distance at which the integral grooves 515 are located beneath the pivotal connection 520 of the foot handles 509 to the post 506 are included within the scope of the invention. That is, a resulting configuration between the actionable hinged portion 511, the post 506, and the foot handles 509 for another embodiment of the invention can form a relationship which is not an equilateral triangle in shape and for which the actionable hinged portion 511 is at an angle greater than or less than 45 degrees in reference to the post 506. As one of ordinary skill in the art will understand upon reading this disclosure such adjustments can be made and still achieve the inventive feature of locking the foot handles 509 approximately perpendicular to the post 506 when in the first position while seating the second end 517B of the second one 512B of the two rigid members into the integral groove in the post. One of ordinary skill in the art will further understand upon reading this disclosure that the integral grooves 515 can be replaced by an integral seat, or the like, extending outward from the post 506 rather than the groove extending inward. The invention is not so limited.

From the example embodiment described above and according to the invention when the foot handles 509 are in the first position perpendicular to the post 506, the two rigid members can be locked in alignment (one embodiment of the locking means is detailed below in connection with FIG. 8A–8E) and the second end 517B of the second one 512B of the two rigid members, 512A and 512B can be positioned or seated in the internal groove 515 of the post. In this arrangement, a user can apply a downward force and turning, rotational force to the foot handles which maintains the rigid alignment of the two rigid members, 512A and 512B, forcibly seats the second end 517B of the second one 512B of the two rigid members, 512A and 512B, into the integral groove 515, and transfers the downward force applied to the foot handle 509 along the now fixedly aligned rigid members 512A and 512B and forcefully from the second one 512B of the two rigid members 512A and 512B into the groove 515. This downward and rotational transference of force is further applied from the groove 515 downward along the lower post 506 driving the lower end of the post 506 and the integral anchoring structure into the ground.

As mentioned above, the actionable hinged portion 511 is designed such that the two rigid members, 512A and 512B can only rotate, from the aligned state shown in FIG. 5, in one direction around their connection 513 at their respective first ends. According to this embodiment of the present invention, each one of the two rigid members, 512A and 512B, can rotate through a range of motion of 180 degrees toward the other one of the two rigid members, 512A and 512B while the other one is held in place. Thus the two rigid members, 512A and 512B, can hinge from the fixedly and rigidly aligned state, e.g. when the foot handles 509 are in the first position of FIG. 5, to collectively rotate through a range of motion of 180 degrees allowing the two rigid members, 512A and 512B, to collapse toward one another until the two rigid members, 512A and 512B come to rest parallel to one another and bring the foot handles to rest in a second position parallel to a length of the post 506. As explained next in connection with FIG. 6, this occurs with the simple application of thumb pressure in the direction shown by the arrow in FIG. 5, e.g. an upward pressure at connection 513 in the direction inward toward the post 506 and upward toward the pivotal connection 520 of the foot handles 509 to the post 506. The reciprocal motion occurs for bringing the foot handles 509 from the second position parallel to the length of the post 506 to the first position perpendicular to the length of the post 506.

The above description illustrates one example of the manner in which the foot handles 509 can be locked into a first position perpendicular to a length of the post 506. However, the invention is not so limited. That is, in another embodiment of the present invention the actionable hinged portion 511 is replaced by a single continuous rigid member formed on any of the materials described above, e.g. rigid injection molded plastic, or equivalents thereof. In this embodiment, a first end is pivotally connected to the foot handles 509 as described above and a second end of the single continuous rigid member is freely slidable along the post 506 and can be position to seat in the integral groove 515 or integral seat extending outward from the post 506. However, as one of ordinary skill in the art will understand upon reading this disclosure, when the single continuous rigid member is unseated from the integral groove 515 the single continuous rigid member can freely drop in a pivotal motion around the pin 520 to a position parallel to the length of the post 506 to allow the foot handles 509 to collapse to a second position parallel to the length of the post 506. The collapsed second position of the foot handles 509, parallel to the length of the post 506, is shown next in FIG. 6.

Figure 6:
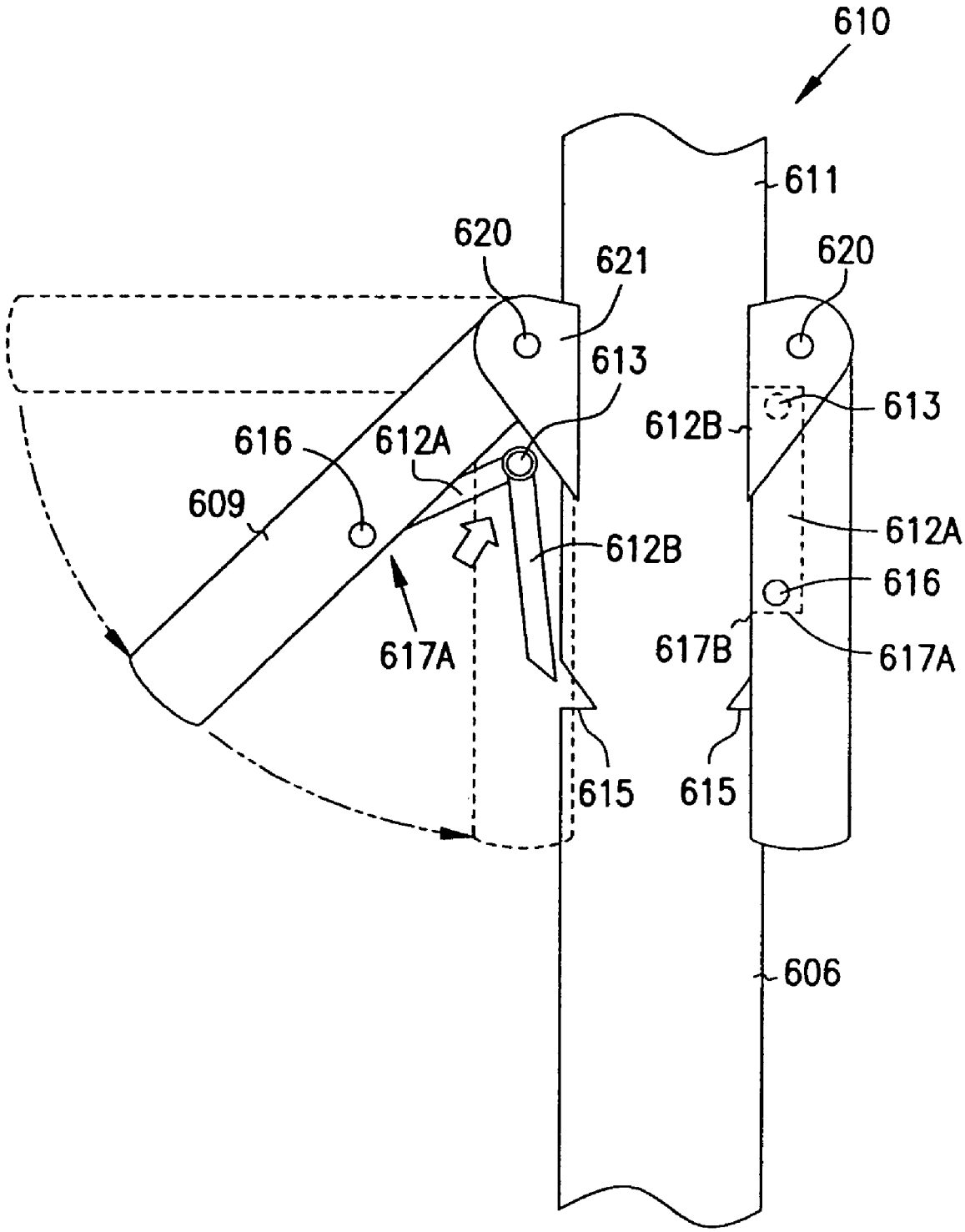
FIG. 6 illustrates the second pair of retractable levers from FIG. 5 in both a retractable motion and in a second position parallel to a post of the umbrella according to the teachings of the present invention.

FIG. 6 illustrates the second pair of retractable levers 610 in both a retractable motion and in a second position parallel to a post 606 of the umbrella according to the teachings of the present invention. In FIG. 6, the foot handles 609 are shown rotatably moving through 90 degrees to finally rest in a second, unengaged position parallel position to the lower post 606. Again, according to one embodiment described in connection with FIG. 5, the range of motion of the foot handles 609 is actuated as easily as applying an upward force, e.g. using a finger or thumb, to the middle hinge 613 to disengage the hinged alignment, end to end, of the two rigid members 612A and 612B. As the foot handles 609 are released and rotated downward about their pivotal connection 620 to the post 606, the two rigid members can collectively rotate through a range of motion of 180 degrees about their pivotal connection 613 allowing the two rigid members 612A and 612B to collapse toward one another until the two rigid members, 612A and 612B come to rest parallel a flat against one another and the foot handles 609 come to rest in a second position parallel to a length of the post 606. As one of ordinary skill in the art will understand upon reading this disclosure, the action described herein allows the freely slidable second end 617B of the second one 612B of the two rigid members 612A and 612B to releasably disengage from the integrally formed groove 615 in the lower post 606 and freely slide upward as the first one 612A of the two rigid members 612A and 612B collapses inward and pivots about its pivotal connection 616 with the foot handles 609 and finally folds flat against the length of the second one 612B the two rigid members 612A and 612B. Alternatively, as mentioned above, if the actionable hinged portion were replaced with the a single continuous rigid member one end of the single rigid member would be unseated from the integral groove 615 and allowed to freely slide and drop downward along the post 606 while the other end of the single continuous rigid member rotated about its pivotal connection 616 with the foot handles 609, again allowing the foot handles 609 to rotate downward until coming to rest parallel to the length of the post 606 in the second position. FIG. 6 thus illustrates an inventive aspect of the invention is illustrating the foot handles 609 of the foot levers 610 retracted into a second position parallel to the lower post 606 so that the one or more retractable foot levers 610 do not poke, snag, or otherwise encumber a person moving or situated under and around the umbrella when the umbrella is in use. Similarly, another advantageous feature of the present invention is that the one or more retractable foot levers 610 facilitate an ease of transport and storage, such as in an umbrella carrying case, once the same are retracted into the second position. Also, as one of ordinary skill in the art will understand upon reading this disclosure, a reciprocal motion to that described above will return the foot handles 609 from the second position parallel to the length of the post to a first position perpendicular to a length of the post 606 such that the second end 617B of the second one 612B of the two rigid members 612A and 612B can be reseated into the integral groove 615 for use of the foot handles 609.

Figure 7:
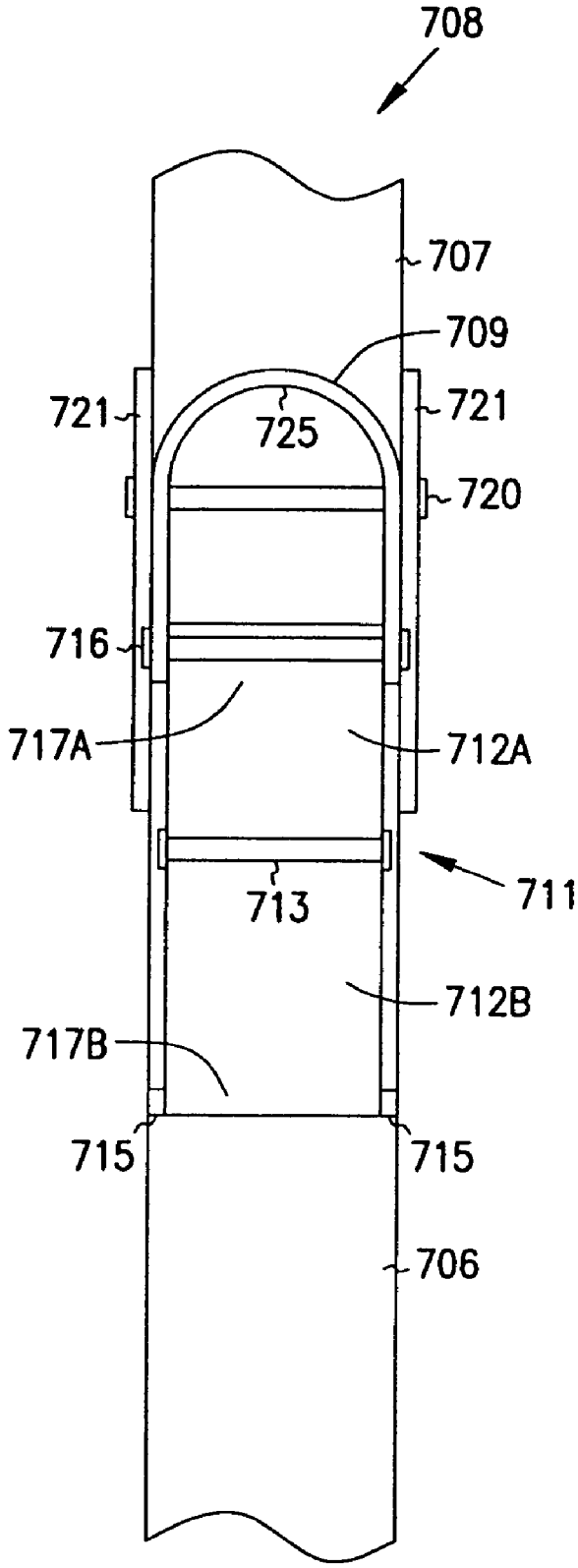
FIG. 7 illustrates a cross sectional view for one embodiment of the one or more retractable levers, according to the teachings of the present invention, such as taken along cut line 7—7 in FIG. 3.

FIG. 7 illustrates a cross sectional view for one embodiment of the one or more retractable levers 708 taken along cut line 7—7 of FIG. 3 according to the teachings of the present invention. As one of ordinary skill in the art will understand upon reading this disclosure, the cross sectional view embodiment shown in FIG. 7 can equally represent a cross sectional view of one embodiment of the arm levers or foot levers described above. In the embodiment shown in FIG. 7, the arm handle 709 includes an open or hollow underbelly 725 in order to more easily conform the seat to the post 706 when the arm handle 709 is in the second position parallel to the length of the post 706 (see FIGS. 4 and 6). The hollow underbelly 725 represents one embodiment which easily facilitates an attachment of the actionable hinged portion 711 in between opposing sides of the arm handle 709. In one embodiment, the actionable hinged portion can be attached using a pin 716 as described above. As one of ordinary skill in the art will understand upon reading this disclosure, in this embodiment the hollow underbelly 725 further allows the actionable hinged portion 711 to seat underneath the hollow underbelly 725 when the arm handle 709 is in the second position parallel to the length of the post 706 (see FIGS. 4 and 6). As with other features of the present invention, this feature provides for a more compact closure to the arm handles and/or foot handles 709 for freeing up space under and around the umbrella when the umbrella is in use and facilitates a greater ease in transport of the umbrella, e.g. in fitting the umbrella into an umbrella carrying case. As one of ordinary skill in the art will understand upon reading this disclosure, a number of shapes and structural designs for the arm handles 709 and the actionable hinged portion 711 are suited to the teachings of the present invention. Some are presented here for ease of illustration, but the invention is not so limited. The invention is to be defined by the aspects, advantages, and features of included claims and equivalents thereof.

In the embodiment of FIG. 7, the arm handle 709 is illustrated with its pivotal connection to the post 706. According to one embodiment as described above, the pivotal connection includes a pin 720 passing through one of a set of protruded members 721 on one side of the post 706 (e.g. a "dog ear"), which in this embodiment is integrally formed to the post, through the arm handles 709, and then through a complimentary one of the set of protruded members 721 on the other side of the post 706. One of ordinary skill in the art will appreciate and understand upon reading this disclosure that these features, components, and aspects of the present invention lend themselves to a streamlined and cost efficient fabrication process for the same, and even more so in an embodiment in which the pair of arm handles are similarly formed of the same material as the post 706 and the set of protruded members 721.

The embodiment shown in FIG. 7 further illustrates one embodiment in which the actionable hinged portion 711 includes two rigid members 712A and 712B. As already described, a first end 717A of a first one 712A of the two rigid members is shown pivotally connected to the arm handle 709 using a pin 716. The embodiment of FIG. 7 further illustrates one embodiment in which the two rigid members 712A and 712B are connected at a first end using a similar pin 713. And, the embodiment of FIG. 7 further illustrates one embodiment in which a second end 717B of a second one 712B of the two rigid members 712A and 712B is seated in an integral groove 715 of the post 706. As described above, in alternative embodiments the actionable hinged portion 711 can include a single continuous rigid member 711 which pivotally connects 716 to the arm or foot lever 709 at one end and can seat in the integral groove 715 of the 706 at its other end. The invention is not so limited.

FIGS. 8A–8E illustrate a number of views showing in greater detail one embodiment of an actionable hinged portion 811 of the one or more retractable levers according to the teachings of the present invention. As shown in the embodiment of FIGS. 8A–8E, the actionable hinged portion 811 includes a two rigid members, 812A and 812B, connected together at a first end 813 of the two rigid members 812A and 812B. In the embodiment shown in FIGS. 8A–8E, the actionable hinged portion is such that the two rigid members can only collectively hinge through a range of motion of 180 degrees about the hinge 813. Thus, from the aligned position shown in FIG. 8A the two rigid members 812A and 812B can hinge in only one direction as indicated by the arrow in FIG. 8A. As noted in FIG. 3, in one embodiment of the invention, the actionable hinged portion 811 can only hinge, from the end-to-end alignment of the two rigid members 312A and 312B, toward the pivotal connection 320 of the arm handles 309 to the post 306. That is, when connected to the arm handles 309, the two rigid members 312A and 312B can hinge at their connection 313 in only one direction, from the aligned position of the two rigid member 312A and 312B, inward toward the post 306 and upward toward the pivotal connection 320 of the arm handles 309 to the post 306 (see FIG. 3). As one of ordinary skill in the art will understand upon reading this disclosure, this feature of this embodiment is advantages for several reasons. First, this configuration allows the two rigid members 812A and 812B to fixedly lock in the end-to-end alignment such that when attached to the arm handles or foot handles and seated against the post, as described above, the two rigid members will transfer a downward application of force from the arm handles downward along the two rigid members 812A and 812B and further downward along the post without collaspsing in the other direction. Second, when the arm handles are in the second position parallel to the length of the post, the actionable hinged member 811 is captured underneath the arm and out of the way so as not to poke, snag, or otherwise interfere with a person moving or situated under and around the umbrella when the umbrella is in use and in order to further facilitate ease of transport of the umbrella.

Figure 8A:
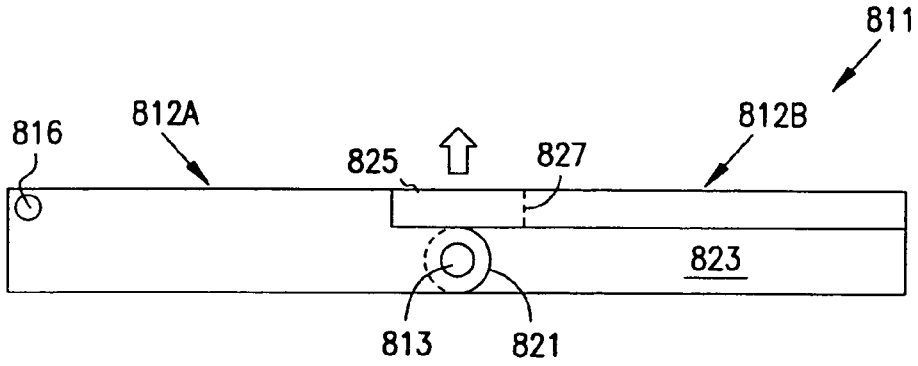
FIGS. 8A–8E illustrate a number of views showing in greater detail one embodiment of an actionable hinged portion of the one or more retractable levers according to the teachings of the present invention.

FIG. 8A illustrates an embodiment of the actionable hinged portion 811 when the two rigid members 812A and 812B are fixedly and rigidly aligned end-to-end. As shown in FIG. 8A, the two rigid members 812A and 812B are locked at their connection 813 from hinging any further in a direction away from the direction in which the arrow is pointing, e.g. in a direction outward from the post 306 and downward away from the pivotal connection of the arm handles 309 to the post 306 as shown in FIG. 3.

As one of ordinary skill in the art will understand upon reading this disclosure, the two rigid members 812A and 812B can be formed from a material selected from the group consisting of wood, metal, or rigid plastic, e.g. injection molded plastic. According to the teachings of the present invention, the ability to fabricate the above recited components of the invention from the same or similar materials provides for a streamlined manufacturing process and reduces manufacturing costs.

As shown in the embodiment of FIG. 8A, the two rigid members, 812A and 812B, are connected together at a first end by a hinge 813. In this embodiment, the hinge includes a pin 813, passing through interleaved portions of the two rigid members, 812A and 812B. According to the invention and as one of ordinary skill in the art will understand upon reading this disclosure, the pin 813 can include any number of suitable material such as aluminum, or other metal alloy, or even plastic. The invention is not so limited and other equivalent connections or hinges 813, such as a spring hinge are included within the scope of the present invention.

As shown in the embodiment of FIG. 8A, a first end of a first one 812A of the two rigid members 812A and 812B is shown with a rounded nub 821 as part of the interleaved portions of the two rigid members 812A and 812B. In this embodiment, the pin 813 passes through these rounded nub portions 821. As one of ordinary skill in the art will understand upon reading the disclosure and as will be more clear in reference to the remaining FIGS. 8B–8E, rounded nub portions 821 allow the interleaved portions of the two rigid members 812A and 812B to rotate around one another. As shown in the embodiment of FIG. 8A, a second one 812B of the two rigid members 812A and 812B includes an indented channel region 823 which, as will be further understood in reference to the remaining figures, is adapted to receive and allow a portion of the first one 812A of the two rigid members 812A and 812B to seat therein in an interleaved fashion when the two rigid members 812A and 812B are in a collapsed position parallel and flat against one another such as when the arm handles are in the second position parallel to the length of the post (see FIG. 8C).

As shown in the embodiment of FIG. 8A and as will be understood from the remaining figures, when the two rigid members 812A and 812B are aligned a portion of each overlaps the other. That is, as shown in FIG. 8A, a portion 825 of the second one 812B of the two rigid members 812A and 812B overlaps the rounded nub portion 821 of the first one 812A of the two rigid members 812A and 812B and seats in a groove or channel therein so as to form an interlocking tongue and groove, or meshed "teeth" configuration (see FIGS. 8D and 8E). As one of ordinary skill in the art will understand from reading this disclosure, this interlocking tongue and groove, or meshed "teeth" configuration locks the two rigid members 812A and 812B firmly against one another such that the two rigid members 812A and 812B are fixedly aligned together end-to-end and prevented from hinging any further in a direction opposite the arrow shown in FIG. 8A once in alignment, end-to-end. A dashed line is provided to indicate that the first one 812A of the two rigid members 812A and 812B includes a similar overlap portion above a rounded nub portion 821 of the second one 812B of the two rigid members 812A and 812B to form this tongue and groove, or meshed "teeth" configuration. As shown in the embodiment of FIG. 8A, a first one 812A of the two rigid members 812A and 812B includes a hole 816 passed through one end. As one of ordinary skill in the art will understand upon reading this disclosure, the hole 816 is adapted to receive a pin, similar to pin 813, through this end of the first one 812A of the two rigid members 812A and 812B so that this end can be pivotally connected to the arm levers as described in more detail in connection with FIG. 3 above.

Figure 8B:
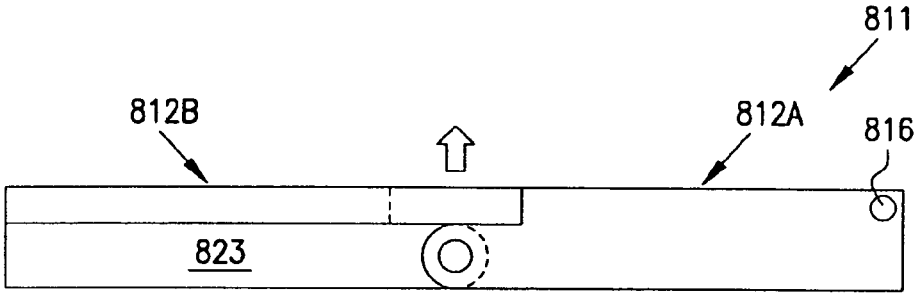

FIG. 8B illustrates the embodiment of FIG. 8A viewed from the opposite side. As will be understood by one of ordinary skill in the art upon reading this disclosure, the structure of the actionable hinged portion 811 when viewed from this side mirrors that described above.

Figure 8C:
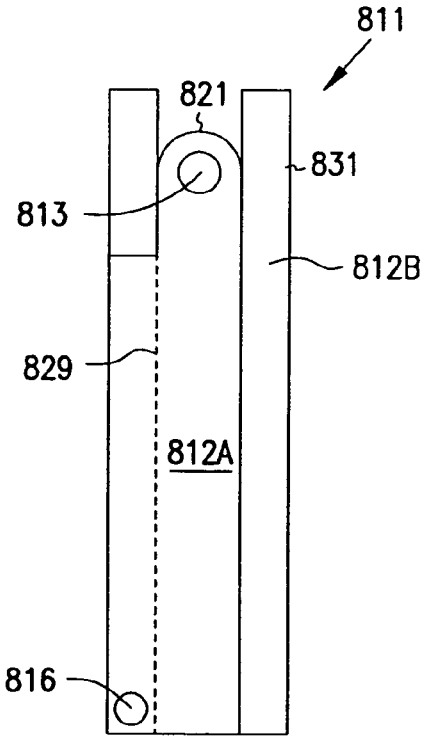

FIG. 8C illustrates an embodiment of the actionable hinged portion 811 when the two rigid members 812A and 812B are fully collapsed parallel and flat against one another as when the arm handles are in the second position parallel to the length of the post. The embodiment shown in FIG. 8C, more clearly illustrates that each one of the two rigid members 812A and 812B include a rounded nub portion 821 interleaved together. The collapsed view of FIG. 8C further illustrates the manner in which interleaved portions of each one of the two rigid members 812A and 812B can seat in the alternating channels, e.g. channel 823 of FIG. 8A, of the other as illustrated by the dashed line 829. FIG. 8C further illustrates in this collapsed view an indented channel or groove in the first one 812A of the two rigid members 812A and 812B which is adapted to receive, mesh and lock with the overlap portion, "tooth," or "tongue" 831 protruding from the pivotally connected end of the second one 812B of two rigid members 812A and 812B.

Figure 8D:
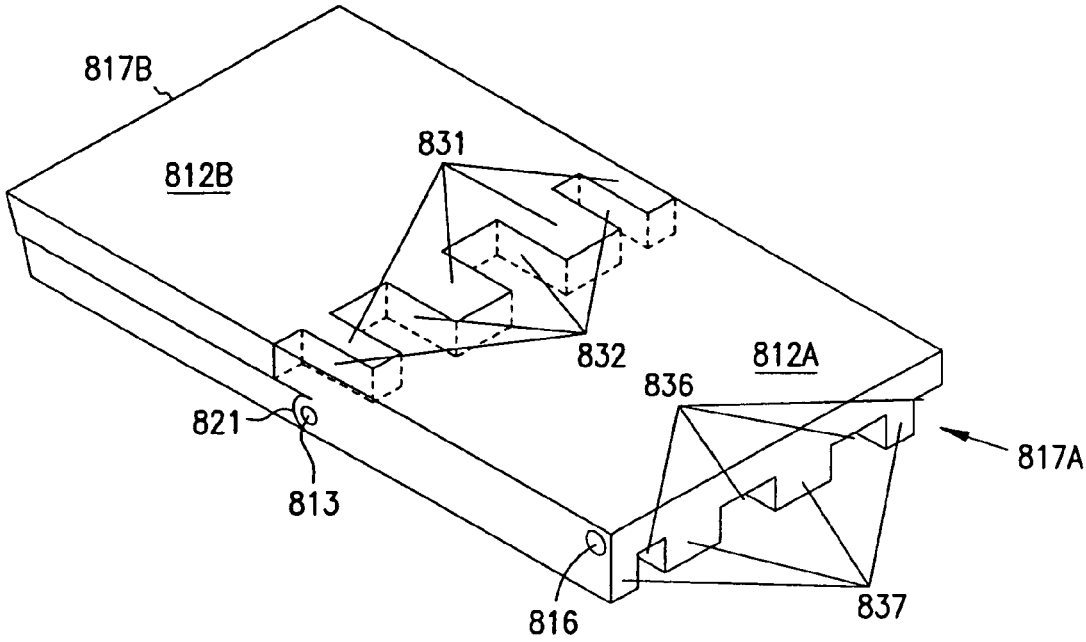

FIG. 8D is a perspective view of the embodiment the two rigid members 812A and 812B fixedly and rigidly aligned end-to-end. FIG. 8D illustrates that each one of the two rigid members 812A and 812B include tongue and grooves, or meshed teeth, 831 and 832 respectively. The dashed lines illustrate that in this embodiment the tongues or teeth do not have a depth equal to the full depth of the two rigid members 812A and 812B. Instead the tongues or teeth, 831 and 832, overlap the rounded nub portions 821 of the opposite one of the two rigid members 812A and 812B is this interleaved embodiment. The perspective view of FIG. 8D further illustrates on the end of the first one 812A of the two rigid members 812A and 812B that each one of the two rigid members 812A and 812B alternates through its width between a number of channels 836 adapted to receive and seat portions of the other member, and portions 837 which are formed to a full depth of the member which include the rounded nub protrusion having the pin 813 passing through them on the opposite end from end 817A where the two rigid members are pivotally connected. One of ordinary skill in the art will appreciate from reading this disclosure that the channels 836 which receive or seat portions of the other member advantageously provide for a more compact structure when the two rigid members are collapsed parallel and flat against one another when the arm handles are in the second position parallel to the length of the post.

Figure 8E:
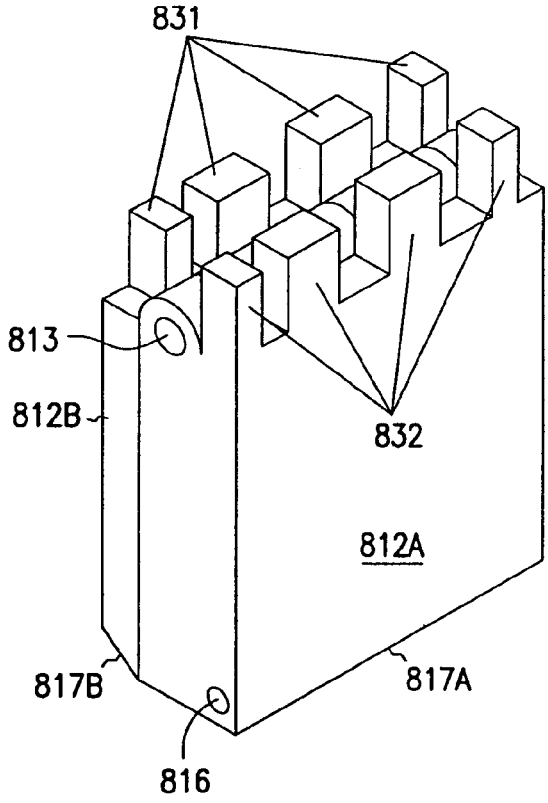

FIG. 8E illustrates a perspective view of this embodiment when the two rigid members 812A and 812B are in the collapsed position against one another (as in FIG. 8C) when the arm handles are in the second position parallel to the length of the post. The perspective view of FIG. 8D is further helpful in appreciating the tongue and groove, or "teeth" configuration, 831 and 832, of this embodiment according to the teachings of the present invention.

FIGS. 8A–8D, provide just one illustration for an actionable hinged portion 811 embodiment according to the teachings of the present invention. However, as stated above other embodiments are similarly included within the scope of the present invention as will become apparent to one of ordinary skill in the art upon reading this disclosure. Other variants for the same include a spring hinge or an actionable hinged portion which consist of a single continuous rigid member, both of which can be pivotally connected to an arm handle and seat against the post as described above according to the teachings of the present invention. The invention is not so limited.

As stated earlier, one advantageous feature of the present invention is that the one or more retractable levers can be retracted and when in a second position parallel to the length of the post do not snag, poke, or otherwise interfere with a person moving or situated under and around the umbrella when the umbrella is in use or when the umbrella is being stored or transported. According to one embodiment of the invention, a weight of the one or more retractable levers themselves maintains the one or more retractable levers in the second position parallel to the length of the post when the one or more retractable levers are not in use and prevents the same from flapping around in the breeze or in stormy conditions such as sudden wind gusts. However, FIG. 9 illustrates another embodiment of the present invention in which the one or more retractable levers are further provided with a releasable locking means to additionally hold and secure the one or more retractable levers in the second position parallel to the length of the post when the one or more retractable levers are not in use.

Figure 9:
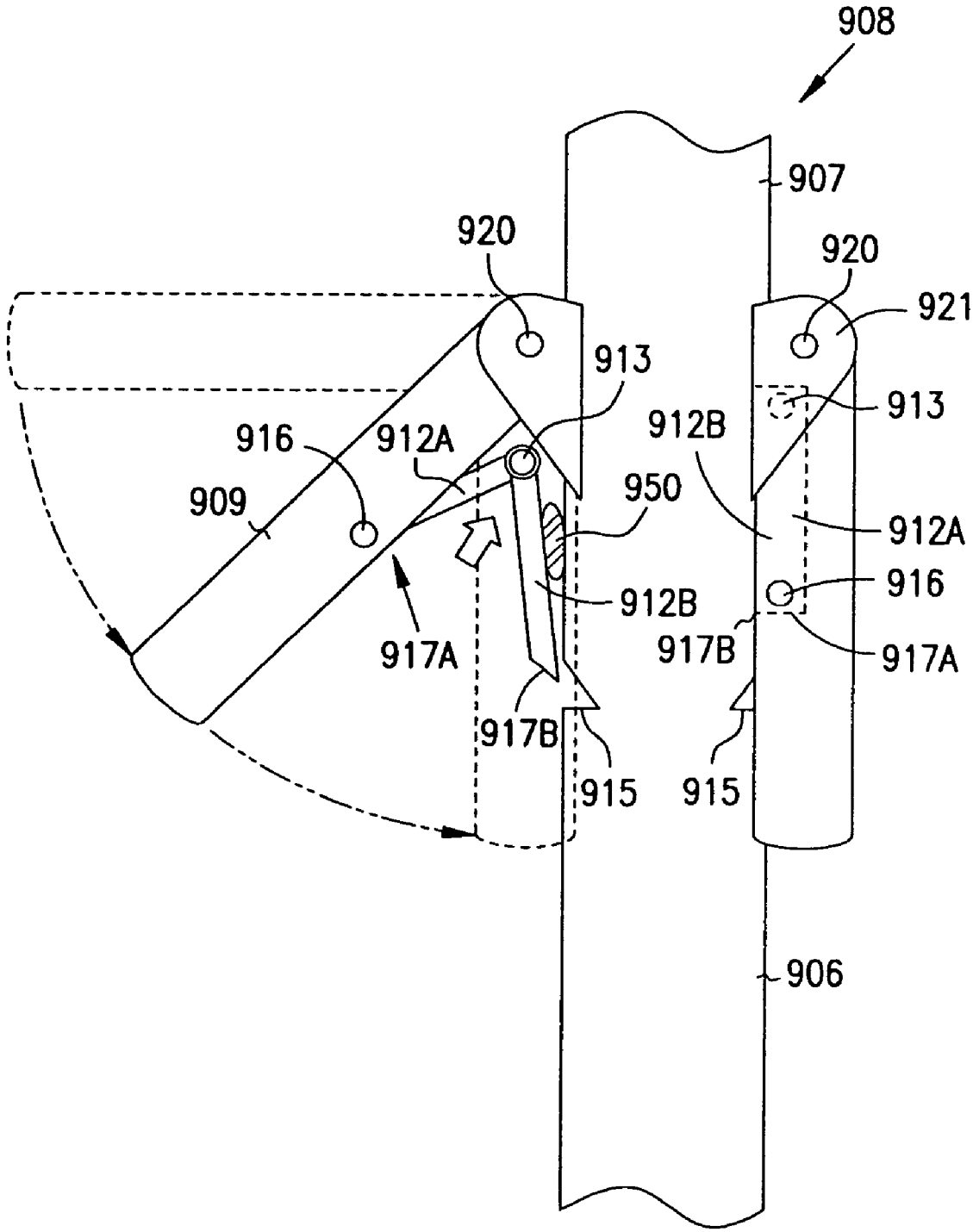
FIG. 9 illustrates in more detail one embodiment by which the one or more retractable levers can be releasably secured in a second position parallel to the post of the umbrella according to the teachings of the present invention.

In the embodiment shown in FIG. 9 the one or more retractable levers 908 include a frictional device 950, such as a rubber stop or hook and loop device 950, located beneath the arm of foot handles 909. As shown in the embodiment of FIG. 9, the frictional device 950 can be affixed to a second one 912A of the two rigid members 912A and 912B or the post 906 itself in the case of a rubber stop. Alternatively, in the embodiment of a hook and loop device, one portion of the hoop and loop device, such as the hooks, can be affixed to the second one 912A of the two rigid members 912A and 912B and the other portion, such as the loops, can be affixed to the post 906, or vice versa. One of ordinary skill in the art will understand upon reading this disclosure, the manner in which a frictional device, such as a rubber stop or a hook and loop device 950, can be affixed to a second one 912B of the two rigid members 912A and 912B, a single continuous rigid member in the alternative embodiments described above, the post 906, or both. In this embodiment according to the teachings of the present invention, the one or more retractable levers 908 including the one or more retractable hand or foot handles 909 are able to releasably secure in the second position parallel to the lower post section. That is in one embodiment, using a rubber material affixed underneath the one or more retractable handles 909, the rubber material 950 frictionally grasps a retractable handle 909 when the handle 909 is in a second position parallel to a length of the post 906 and frictionally releases the retractable handle 909 when a small outward pressure is applied to a lower end of the retractable handle 909 in order to initiate an upward range of motion for the handle 909 into the first position perpendicular to the length of the post.

Figure 10:
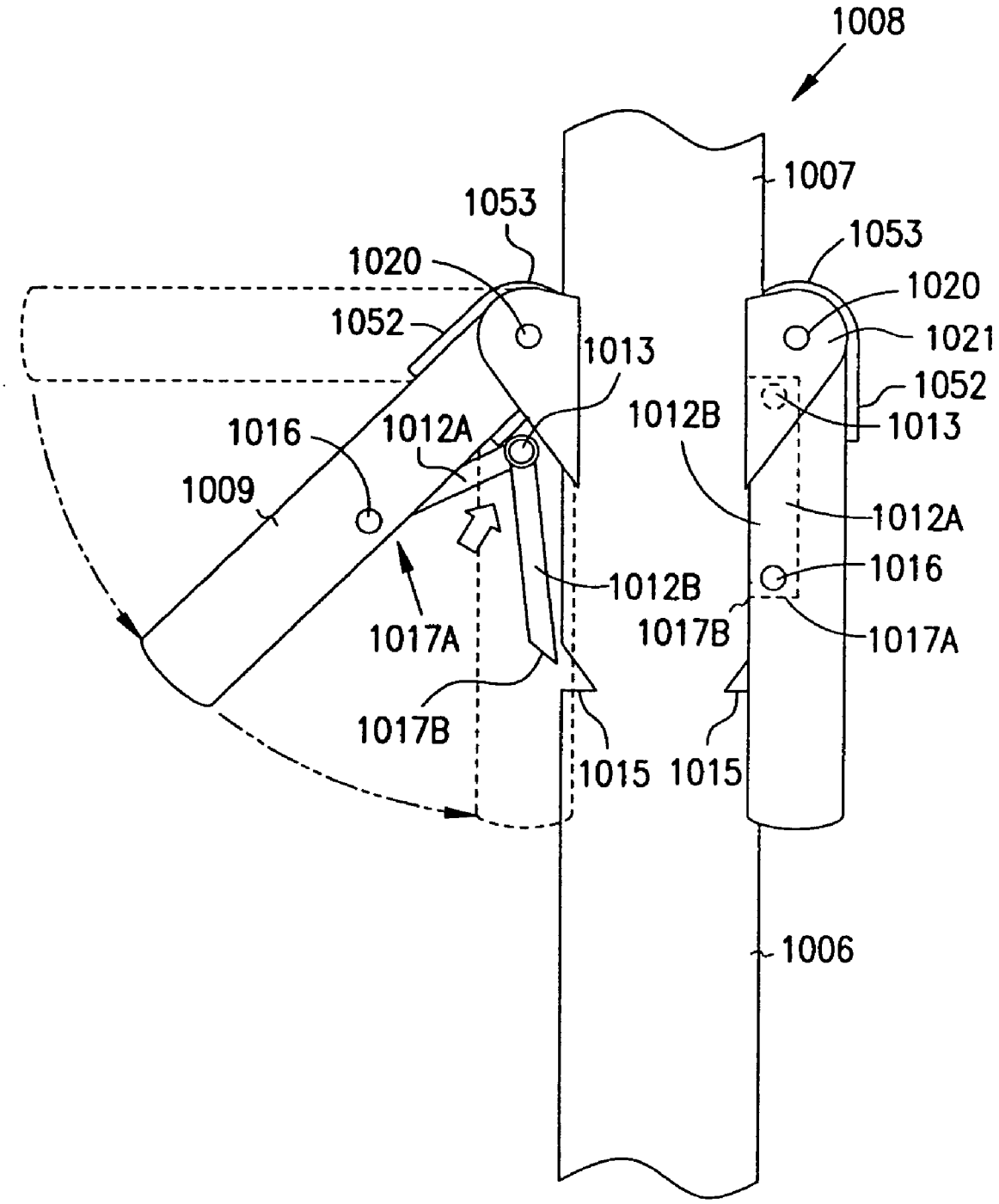
FIG. 10 illustrates in more detail another embodiment by which the one or more retractable levers can be releasably secured in a second position parallel to the post of the umbrella according to the teachings of the present invention.

In the embodiment shown in FIG. 10 the one or more retractable levers 1008 include a frictional device 1052, such as a leaf spring 1052, attached to the one or more hand or foot handles 1009. In the embodiment of FIG. 10, the frictional device 1052 is shown as a leaf spring affixed to a top surface 1052 of a retractable handle and freely curving 1053 between the pivotally connected retractable handle 1009 and the post 1006 and continuing to curve underneath the retractable handle 1009. One of ordinary skill in the art will understand upon reading this disclosure, the manner in which such a leaf spring 1052 can be affixed to a the are or foot handle 1009 in the configuration described above. Advantageously, the leaf spring 1052 can even be formed of the same or similar material as the arm and/or foot handles 1009 to provide for a streamlined manufacturing process and reduce manufacturing costs. In this embodiment according to the teachings of the present invention, the one or more retractable levers 1008 including the one or more retractable hand or foot handles 1009 are able to releasably secure in the second position parallel to the lower post section 1006. That is in one embodiment, using a spring leaf 1052, formed of wood, metal, or injection molded plastic, affixed to the one or more retractable handles 1009 is able to frictionally grasp a retractable handle 1009 when the handle 1009 is in a second position parallel to a length of the post 1006 and frictionally releases the retractable handle 1009 when a small outward pressure is applied to a lower end of the retractable handle 1009 in order to initiate an upward range of motion for the handle 1009 into the first position perpendicular to the length of the post 1006.

Figure 11:
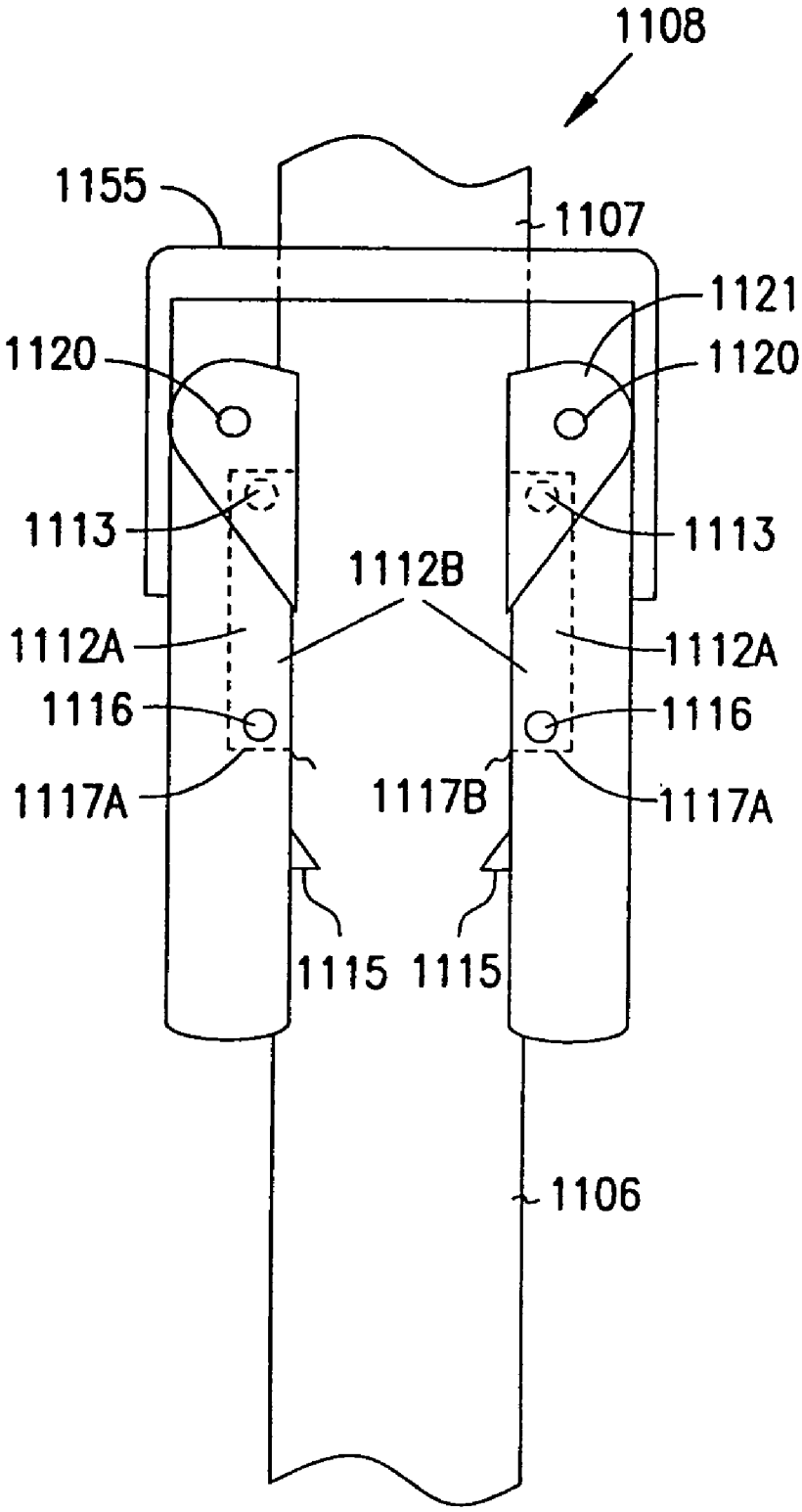
FIG. 11 illustrates in more detail another embodiment by which the one or more retractable levers can be releasably secured in a second position parallel to the post of the umbrella according to the teachings of the present invention.

In the embodiment shown in FIG. 11, the invention is shown with another embodiment of a locking means 1155, or clasping means 1155, which either slidably surrounds the post 1106 above one or more retractable levers 1108, or which slidably is attached on opposite sides of the post 1106 above 1106 above one or more retractable levers 1108. One of ordinary skill in the art will understand upon reading this disclosure, the manner in which such a locking means 1155 can be provided in the configuration described above. Advantageously, the locking means 1155 can even be formed of the same or similar material as the arm and/or foot handles 1109 to provide for a streamlined manufacturing process and reduce manufacturing costs. In this embodiment according to the teachings of the present invention, the one or more retractable levers 1008 including the one or more retractable hand or foot handles 1009 are able to releasably secure in the second position parallel to the lower post section 1006. That is in one embodiment, using a locking means 1155, formed of wood, metal, or injection molded plastic, affixed in the configuration described above, the one or more retractable handles 1009 are able to releasably secure in the second position parallel to the lower post section 1006.

The above embodiments described in connection with FIGS. 9–11 afford the additional advantage that the one or more retractable levers will not swing or flap out from the second position parallel to the length of the post when not in use from forces as sudden strong wind gusts or when the post is oriented in a position other than parallel to the ground such as when the umbrella is positioned in use in a tilted or angled position with the ground or such as when the umbrella is horizontal to the ground for transport or for sliding into an umbrella carrying case.

Figure 12:
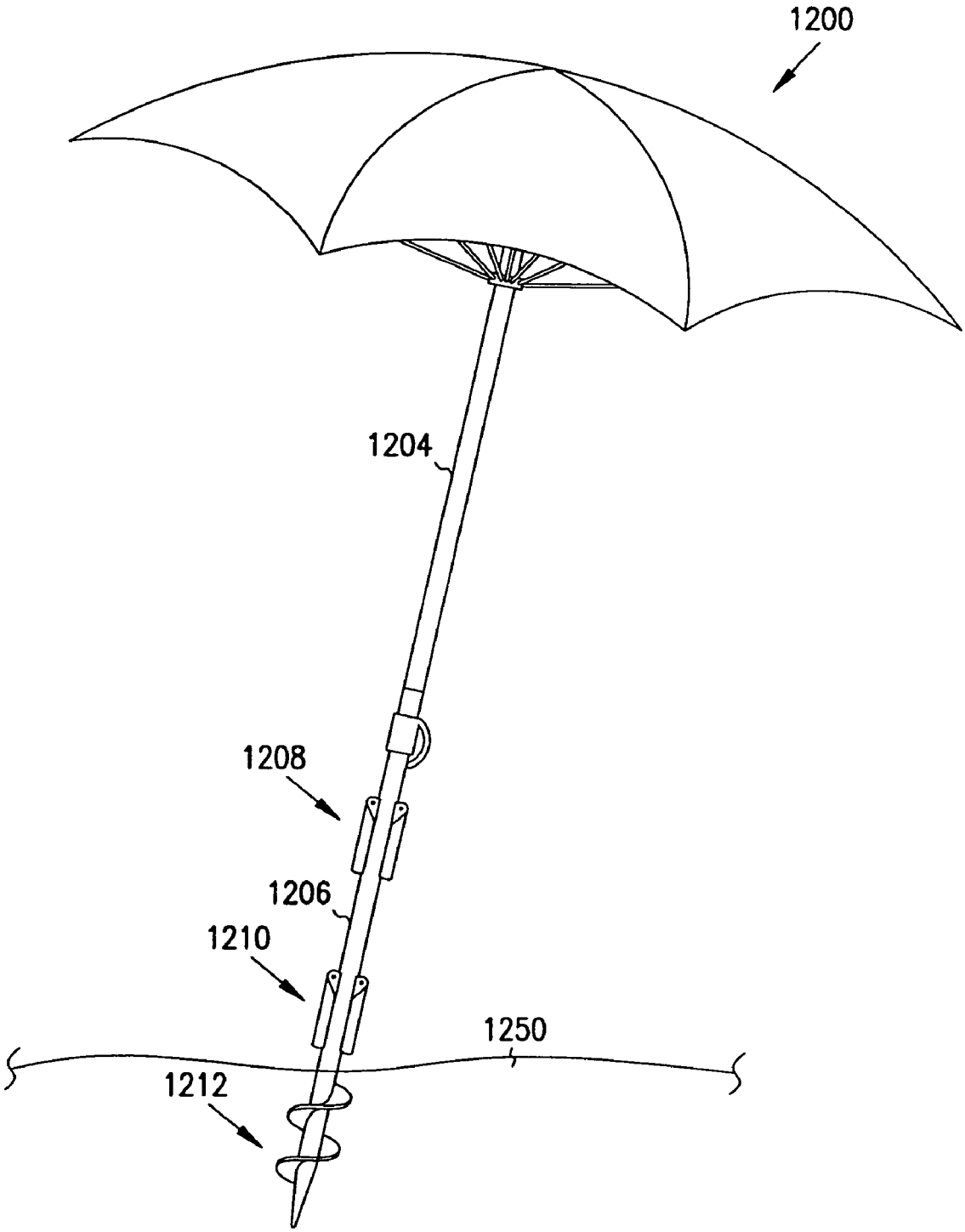
FIG. 12 illustrates an embodiment of an umbrella including an anchoring structure according to the teachings of the present invention when the same is in use.

FIG. 12 illustrates an embodiment of an umbrella 1200 including an anchoring structure according to the teachings of the present invention. FIG. 12 illustrates the umbrella in use after the post 1206 has been inserted into the ground 1250, such as sand, lawn, soil, or other earthen material, and the one or more retractable arm levers, 1208 and 1210, have been retracted to a second position parallel to a length of the post 1206 so that the one or more retractable arm and foot levers, 1208 and 1210, do not poke, snag, or otherwise interfere with a person moving or situated under and around the umbrella is in use. In FIG. 12, the umbrella 1200 is shown positioned at an angle relative to the ground. This presentation exemplifies that the features, aspects, and advantages of the present invention further enables the umbrella 1200 to easily be securely positioned in the ground at any angle, e.g. for maximum shade from the sun.

Figure 13:
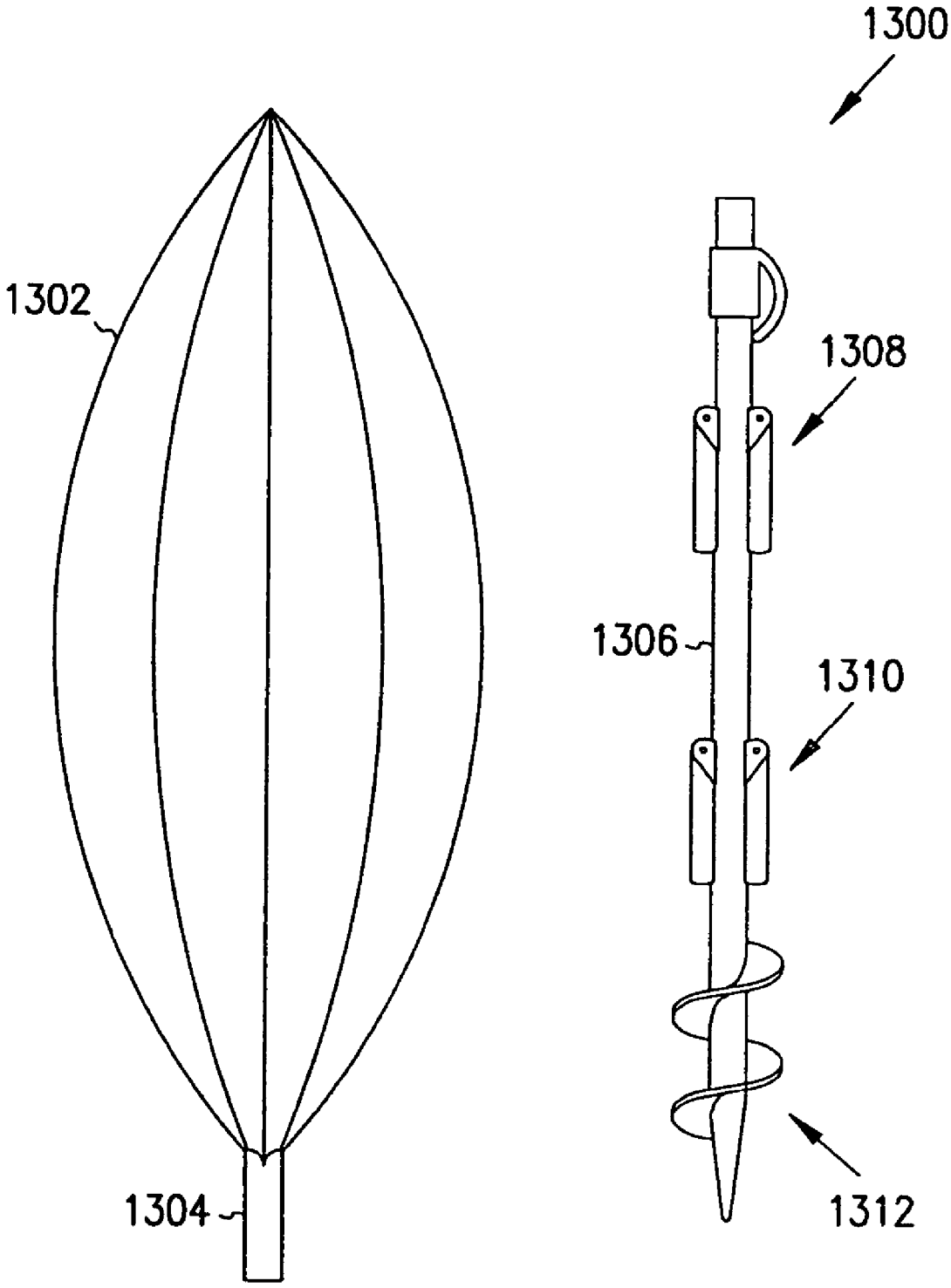
FIG. 13 illustrates an embodiment of an umbrella including an anchoring structure according to the teachings of the present invention when the umbrella has the one or more retractable levers retracted in a second position parallel to a length of the post and the post is broken down for transport or storage, such as in an umbrella carrying case.

FIG. 13 illustrates an embodiment of an umbrella 1300 according to the teachings of the present invention. The umbrella 1300 shown in FIG. 13 includes an embodiment of a two-sectional umbrella as described previously. In FIG. 13, the umbrella 1300 is shown broken down into its two sections including an upper post section 1304 attached to and supporting a retracted umbrella top and a lower post section 1306. In one embodiment, the lower post section includes one or more retractable levers, 1308 and 1310, integrally attached along the post 1306, and an integral anchoring structure 1312 as the same have been described herein. FIG. 13 illustrates the one or more retractable levers, 1308 and 1310, in the above described second position to facilitate an ease of transport of the lower post section 1306. As one of ordinary skill in the art will understand upon reading this disclosure, the embodiment shown in FIG. 13 further exemplifies that the features, aspects, and advantages of the present invention further enables the umbrella of the present invention to be compactly transported and stored such as in an umbrella carrying case.

In at least one embodiment of the present invention, the reference to an integral anchoring structure includes in its scope of definition the one or more retractable levers. In this embodiment, the umbrella with an integral anchoring structure is claimed with only the one or more retractable levers integrally attached along the umbrella post without the integral spiral shaped anchoring structure, shown as 112 in FIG. 1, included.

CONCLUSION

In sum, the above described invention includes an umbrella with an integral anchoring structure. The lower post of the umbrella includes one or more retractable arm levers and one or more retractable foot levers integrally attached to the lower post. The one or more retractable arm levers and one or more retractable foot levers integrally attached to the lower post enable a user to apply downward pressure using their arms and feet, through a rotational/turning movement of the lower post, to obtain added downward force or assistance in order to facilitate insertion of the lower post into the ground. The one or more retractable arm levers and one or more retractable foot levers integrally attached to the lower post in a retracted position provided added convenience such that the same do not poke, snag, or otherwise encumber a person moving or situated under and around the umbrella. Likewise, the same being in a retracted position facilitate a greater ease of transport.

According to the teachings of the present invention, the lower end of the lower post includes and integrally formed spiral shaped portion, serving as an integral anchoring structure, in order to facilitate an insertion of the lower post into the ground and retention therein upon being so inserted. The integrally formed spiral shaped anchoring structure serves two purposes. One includes an added ease for inserting the lower post into the earth in conjunction with the above described rotational downward force enabled by the one or more retractable arm and foot levers. A second advantage is afforded by the fact that the integral anchoring structure is formed with a width, W, and a length, L, which is sufficiently adapted to stabilize the weight of the umbrella from toppling under its own weight and securing the same in a variety of earthen conditions, e.g. sand, lawn, soil, etc., even in a prevailing breeze or stormier conditions.

According to the teachings of the present invention, the above described integrally connected members, portions, and components can be formed of plastic, wood, and metal as well as other materials. The integrally connected structure of the present invention affords an added level of convenience for the transport of such an umbrella since the user does not have to keep track of multiple pieces or components. Also, according to the teachings of the present invention, the ability to fabricate the above recited components of the invention from the same or similar materials provides for a streamlined manufacturing process and reduces manufacturing costs.

These and other embodiments will be known and understood as one of ordinary skill in the art will further appreciate upon reading and understanding the present invention, such embodiments may require The above description and drawings are only to be considered illustrative of exemplary embodiments which achieve the features and advantages of the present invention. Modification and substitutions to specific process conditions and structures can be made without departing from the spirit and scope of the present invention. Accordingly, the invention is not to be considered as being limited by the foregoing description and drawings, but is only limited by the scope of the appended claims.

What is claimed is:

1. A method of manufacturing an umbrella post, comprising:

providing an umbrella post having an upper end including an opening suitable to receive an upper portion of an umbrella top and a lower end for insertion into the ground;

integrally attaching a first handle to a first region of the post;

integrally attaching a second handle to a second region of the post;

wherein the first handle is integrally attached a predetermined distance along a length of the post from the second handle; and wherein the first and the second handle can be locked in a first position perpendicular to the length of the post to receive a downward force applied to the first and the second handle to facilitate insertion of the lower end into the ground.

2. The method of claim 1, wherein integrally attaching includes pivotally attaching the first handle and the second handle such that the first handle and the second handle can move into the first position perpendicular to the length of the post.

3. The method of claim 2, wherein integrally attaching includes pivotally attaching the first handle and the second handle such that the first handle and the second handle can move into a second position parallel to the length of the post.

4. The method of claim 3, wherein integrally attaching includes pivotally attaching the first handle and the second handle such that the first handle and the second handle can releasably lock in the first position relative the post.

5. A method of manufacturing an umbrella, comprising:

constructing a post, where the post includes an upper end including an opening suitable to receive an upper portion of an umbrella top and a lower end for insertion into the ground;

constructing a pair of handles along a first region of the post;

constructing a handle along a second region of the post, the pair of handles along the first region being spaced apart from the handle along the second region by a predetermined distance along a length of the post; and wherein the handles can be locked in a first position perpendicular to the length of the post to receive a downward force applied to the handles to facilitate insertion of the lower end into the ground.

6. The method of claim 5, wherein constructing the pair of handles along the first region and constructing the handle along the second region includes constructing the handles in a retractable manner such that the handles can be moved into the first position perpendicular to the length of the post.

7. The method of claim 6, wherein constructing the pair of handles along the first region and constructing the handle along the second region includes constructing the handles in a retractable manner such that the handles can be moved into a second position parallel to the length of the post.

8. The method of claim 7, wherein constructing the handles in a retractable manner includes constructing the handles such that the handles can be releasably locked in the first position and the second position relative the post.

9. The method of claim 5, wherein constructing the handles includes integrally fabricating the handles along the post.

10. A method of fabricating an umbrella, comprising:

fabricating a post having a lower end and an upper end including an opening suitable to receive an upper portion of an umbrella;

fabricating a pair of hand levers along a first region of the post and a foot lever along a second region of the post, the foot lever being spaced apart from the hand levers by a predetermined distance along a length of the post; and wherein the hand and the foot levers can be locked in a first position perpendicular to the length of the post to receive a downward force applied to the hand and the foot levers to facilitate insertion of the lower end into the ground.

11. The method of claim 10, wherein fabricating the hand levers and the foot lever includes fabricating the hand levers and the foot lever in a retractable manner such that the pair of hand levers and the foot lever can be moved into the first position perpendicular to the length of the post and can be moved into a second position parallel to the length of the post.

12. The method of claim 11, wherein fabricating the hand levers and the foot lever in a retractable manner includes fabricating the hand levers and the foot lever such that the pair of hand levers and the foot lever can be releasably locked in the first position and the second position relative the post.

13. The method of claim 10, wherein fabricating the pair of hand levers and the foot lever includes integrally fabricating the pair of hand levers and the foot lever along the post.

14. An umbrella, comprising:

a post having a lower end and an upper end including an opening suitable to receive an upper portion of an umbrella top;

a pair of handles attached to a first region of the post;

a handle attached to a second region of the post, wherein the first region and the second region are spaced apart by a predetermined distance along the post; and wherein the handles can be locked in a first position perpendicular to a length of the post to receive a downward force applied to the handles to facilitate insertion of the lower end into the ground.

15. The umbrella of claim 14, wherein the pair of handles attached to the first region can be retracted into a second position parallel to the length of the post.

16. The umbrella of claim 15, wherein the handle attached to the second region can be retracted into a second position parallel to the length of the post.

17. An umbrella, comprising:

a post having a lower end for insertion into the ground, and an upper end including an opening suitable to receive an upper portion of an umbrella top;

two or more handles attached at a first region of the post;

two or more handles attached at a second region of the post, wherein the first region and the second region are separated by a distance along the post; and wherein the handles can be locked in a first position perpendicular to a length of the post to receive a downward force applied to the handles to facilitate insertion of the lower end into the ground.

18. The umbrella of claim 17, wherein the two or more handles attached at the first region and the two or more handles attached at the second region can retract into a second position parallel to the length of the post.

19. An umbrella, comprising:

a post comprising an upper region including an opening suitable to receive an upper portion of an umbrella top and a lower region;

three or more handles pivotally connected to the post, the three or more handles having a range of motion including a first position perpendicular to a length of the post to receive a downward force applied to the handles to facilitate insertion of the lower region into the ground and including a second position parallel to the length of the post;

wherein the three or more handles include at least one handle attached at the lower region of the post and at least two handles attached toward the upper region of the post; and wherein the handles attached toward the upper region are separated from the handle attached at the lower region by a predetermined distance along the post.

20. The umbrella of claim 19, wherein the three or more handles have a downward range of motion from the first position to the second position and an upward range of motion from the second position to the first position.

21. The umbrella of claim 19, wherein where the handles attached toward the upper region are separated from the handle attached at the lower region by a distance greater than two feet.

22. The umbrella of claim 19, wherein the three or more handles pivotally connected to the post have a range of motion of 180 degrees.

23. An umbrella post, comprising:

a post having a lower region and an upper region including an opening suitable to receive an upper portion of an umbrella top;

three or more handles formed directly on the post, wherein the three or more handles include a first handle attached at the lower region of the post and a pair of handles attached at a different region of the post and spaced apart from the first handle by a predetermined distance; and wherein the handles can be locked in a first position perpendicular to a length of the post to receive a downward force applied to the handles to facilitate insertion of the lower region into the ground.

24. The umbrella post of claim 23, wherein the pair of handles and the first handle can be movably positioned into the first position perpendicular to a length of the post and movably positioned into a second position parallel to the length of the post.

* * * * *